US008205956B2

(12) United States Patent
Kawamata et al.

(10) Patent No.: US 8,205,956 B2
(45) Date of Patent: Jun. 26, 2012

(54) IMAGE RECORDING APPARATUS

(75) Inventors: Noriyuki Kawamata, Nagoya (JP); Takashi Ohama, Iwakura (JP); Naokazu Tanahashi, Nagoya (JP); Wataru Sugiyama, Aichi-ken (JP); Yuta Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/185,288

(22) Filed: Jul. 18, 2011

(65) Prior Publication Data

US 2011/0273524 A1 Nov. 10, 2011

Related U.S. Application Data

(62) Division of application No. 12/238,181, filed on Sep. 25, 2008, now Pat. No. 7,997,676.

(30) Foreign Application Priority Data

Sep. 28, 2007 (JP) ..... 2007-254385

(51) Int. Cl.
*B41J 2/01* (2006.01)
*B41J 29/38* (2006.01)

(52) U.S. Cl. ..... 347/16; 347/104

(58) Field of Classification Search ..... None
See application file for complete search history.

(56) References Cited

U.S. PATENT DOCUMENTS 4,935,786 A 6/1990 Veeder
5,055,885 A 10/1991 Yoshikado et al.
5,974,283 A 10/1999 Cho
5,974,298 A 10/1999 Urban et al.
6,069,704 A 5/2000 Verhaag
6,144,814 A 11/2000 Newell, Jr. et al.
(Continued)

FOREIGN PATENT DOCUMENTS

JP 2005-074745 A 3/2005
(Continued)

OTHER PUBLICATIONS

Japan Patent Office, Notification of Reason for Refusal for Japanese Patent Application No. 2007-254385 (counterpart to above-captioned patent application), dispatched Aug. 16, 2011.

(Continued)

*Primary Examiner* — Stephen Meier
*Assistant Examiner* — Leonard S Liang
(74) *Attorney, Agent, or Firm* — Baker Botts L.L.P.

(57) ABSTRACT

An image recording apparatus configured to record images on front and back surfaces of a sheet, including: a head which ejects ink onto the sheet for recording; a sheet-supply roller which contacts the sheet so as to transfer the sheet for supplying to the head; a sheet-supply path which is provided between the sheet-supply roller and the head, which has a U-shape, and through which the sheet is transferred such that one of surfaces thereof opposite to the other of the surfaces contacted by the sheet-supply roller faces the head; and a sheet-stopping control section configured to control the sheet-supply roller such that the sheet transferred by the sheet-supply roller is stopped for a first time in the sheet-supply path in a state in which the sheet is deformed so as to have a U-shape, after an image has been recorded on the front surface of the sheet and before an image is recorded on the back surface thereof.

15 Claims, 15 Drawing Sheets

U.S. PATENT DOCUMENTS

| | | | | |
|---|---|---|---|---|
| 6,167,231 | A * | 12/2000 | Blackman et al. | 399/364 |
| 6,250,754 | B1 | 6/2001 | Bortolotti | |
| 6,652,060 | B2 | 11/2003 | Uchida | |
| 6,679,600 | B1 | 1/2004 | Regimbal | |
| 6,719,469 | B2 | 4/2004 | Yasui et al. | |
| 6,810,224 | B2 | 10/2004 | Ahn | |
| 7,108,368 | B2 | 9/2006 | Saito et al. | |
| 7,185,981 | B2 * | 3/2007 | Tham et al. | 347/104 |
| 7,192,207 | B2 | 3/2007 | Ohashi et al. | |
| 7,311,368 | B2 | 12/2007 | Kawakami | |
| 7,434,928 | B2 | 10/2008 | Dohki | |
| 7,458,674 | B2 | 12/2008 | Itoh | |
| 7,515,520 | B2 | 4/2009 | Kotaka et al. | |
| 7,520,586 | B2 | 4/2009 | Itoh | |
| 7,576,875 | B2 | 8/2009 | Momose | |
| 7,722,180 | B2 | 5/2010 | Mashima | |
| 2003/0020228 | A1 | 1/2003 | Kobayashi et al. | |
| 2003/0094108 | A1 | 5/2003 | Shiki | |
| 2004/0207707 | A1 | 10/2004 | Ohashi et al. | |
| 2004/0263553 | A1 | 12/2004 | Mizuno | |
| 2005/0046686 | A1 | 3/2005 | Iwakura et al. | |
| 2005/0275672 | A1 | 12/2005 | Koshikawa | |
| 2005/0280685 | A1 * | 12/2005 | Yokoi | 347/104 |
| 2006/0038870 | A1 | 2/2006 | Nonaka | |
| 2006/0164491 | A1 | 7/2006 | Sakuma et al. | |
| 2006/0268089 | A1 | 11/2006 | Takeuchi | |
| 2007/0030299 | A1 | 2/2007 | Izuchi | |

FOREIGN PATENT DOCUMENTS

| | | | |
|---|---|---|---|
| JP | 2006-082546 | A | 3/2006 |
| JP | 2006-145685 | A | 6/2006 |
| JP | 2006-327793 | A | 12/2006 |
| JP | 2007-091398 | A | 4/2007 |
| JP | 2007-130930 | A | 5/2007 |

OTHER PUBLICATIONS

Japan Patent Office, Decision of Refusal for Japanese Patent Application No. 2007-254385 (counterpart to above-captioned patent application), dispatched Apr. 17, 2012.

* cited by examiner

IMAGE RECORDING APPARATUS

CROSS REFERENCE TO RELATED APPLICATION

This application is a divisional application of U.S. patent application Ser. No. 12/238,181, filed on Sep. 25, 2008, which claims the benefit of Japanese Patent Application No. 2007-254385, which was filed on Sep. 28, 2007, the disclosures of which are incorporated herein by reference in their entirety.

BACKGROUND OF THE INVENTION

1. Field of the Invention

The present invention relates to an image recording apparatus.

2. Description of the Related Art

There is conventionally known an ink jet image recording apparatus configured to record images on a front surface and a back surface of a recording sheet. Patent Document 1 (Japanese Patent Application Publication No. 2006-82546) discloses a technique relating to such an image recording apparatus. In the technique, a recording sheet 5, on one of surfaces of which an image has been recorded, is stopped on a flat lower guide plate 170A disposed downstream of a recording head 24, and the stopped recording sheet 5 is sandwiched and held from upper and lower sides thereof by sheet-transfer rollers 71, 171, 172, 173 and spur rollers 72, 174, 175, 176 that respectively face the sheet-transfer rollers 71, 171, 172, 173, whereby curling of the recording sheet 5 is less likely to occur.

However, in the above-mentioned technique described in the Patent Document 1, the flat lower guide plate 170A needs to be disposed downstream of the recording head 24 in order to make it difficult to curl the recording sheet 5, thereby unfortunately upsizing the image recording apparatus. Further, in addition to the lower guide plate 170A, the sheet-transfer roller 71, the spur roller 72, and the like for sandwiching and holding the recording sheet 5 need to be mounted, thereby complicating a construction of an interior of the image recording apparatus.

SUMMARY OF THE INVENTION

This invention has been developed in view of the above-described situations, and it is an object of the present invention to provide an image recording apparatus which can correct a recording sheet in shape with a simple structure and without upsizing of the image recording apparatus.

The object indicated above may be achieved according to the present invention which provides an image recording apparatus configured to record images on a front surface and a back surface of a recording sheet, the image recording apparatus comprising: a recording head which ejects ink onto the recording sheet for recording; a sheet-supply roller which contacts the recording sheet so as to transfer the recording sheet for supplying the recording sheet to the recording head; a sheet-supply path which is provided between the sheet-supply roller and the recording head, which has a U-shape, and through which the recording sheet is transferred such that one of surfaces thereof opposite to the other of the surfaces contacted by the sheet-supply roller faces the recording head; and a controller configured to execute controls for operations of the image recording apparatus, wherein the controller includes a sheet-stopping control section configured to control the sheet-supply roller such that the recording sheet transferred by the sheet-supply roller is stopped for a first time in the sheet-supply path in a state in which the recording sheet is deformed so as to have a U-shape, after an image has been recorded on the front surface of the recording sheet and before an image is recorded on the back surface of the recording sheet.

In the image recording apparatus constructed as described above, the recording sheet whose front surface has been subjected to the recording is curled in the sheet-supply path. Thus, when the recording sheet is transferred from the sheet-supply path to a position facing the recording head, the recording sheet can be smoothly transferred to the position. Further, the recording sheet can be prevented from floating up owing that the recording sheet is not curled, so that jamming of the recording sheet at the position can be prevented. Furthermore, the recording sheet is curled by being stopped for the first time in a state in which the recording sheet is deformed in the sheet-supply path so as to have the U-shape. Thus, the recording sheet can be corrected in shape with a simple structure without mounting an additional physical component on the image recording apparatus and without upsizing the image recording apparatus in order to correct the recording sheet in shape.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF EMBODIMENT

Figure 1:
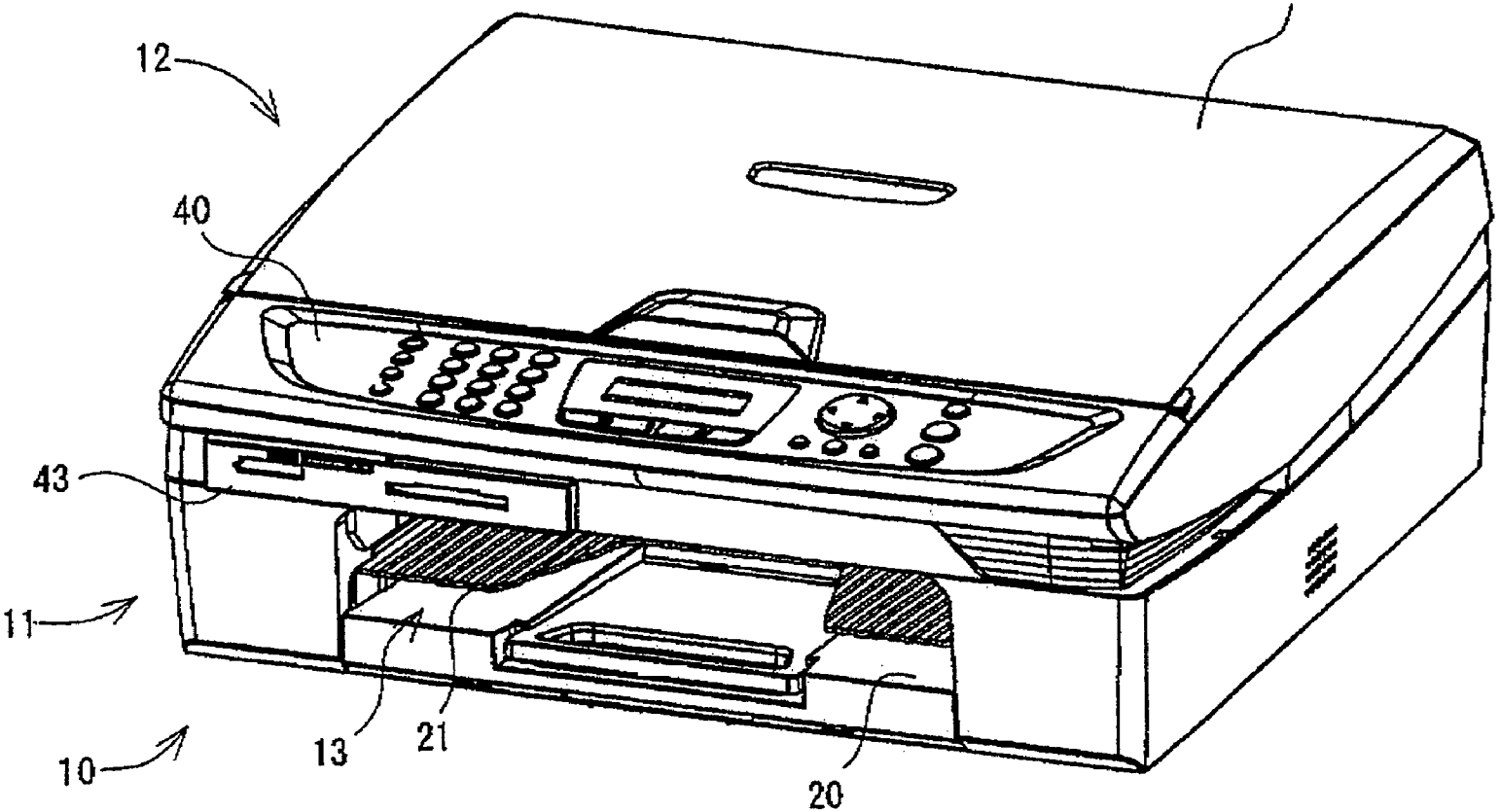
FIG. 1 is a perspective view of an MFD as an embodiment of the present invention.

Hereinafter, there will be described an embodiment of the present invention by reference to the drawings. As shown in FIG. 1, a Multi Function Device (MFD) 10 includes a printer section 11 of an ink-jet type which can record images on both sides (a front surface and a back surface) of a recording sheet as an example of a recording medium.

The MFD 10 has various functions such as a telephone-conversation function, a facsimile function, a printing function, a scanning function, and a copying function. The printing function includes a two-sided printing function in which images are recorded on both sides of the recording sheet.

The MFD 10 includes the printer section 11 at its lower portion, a scanner section 12 at its upper portion, an operation panel 40 at its front upper portion, and a slot portion 43 at its front face.

An opening 13 is formed in a front face of the printer section 11. A sheet-supply tray 20 and a sheet-discharge tray 21 are provided in the printer section 11 so as to be superposed on each other in a vertical direction in a state in which portions of the sheet-supply tray 20 and the sheet-discharge tray 21 are exposed from the opening 13. The sheet-supply tray 20 can accommodate a plurality of recording sheets stacked on each other. The stacked recording sheets accommodated in the sheet-supply tray 20 are supplied, one by one, into the printer section 11. After a desired image is recorded on the front surface of each of the recording sheets, or desired images are recorded on the front and back surfaces of each recording sheet, each recorded recording sheet is discharged onto the sheet-discharge tray 21.

The scanner section 12 functions as what is called a flatbed scanner. A document cover 30 is provided as a top panel of the MFD 10. Under the document cover 30, a platen glass, not shown, is disposed. An original document is placed on the platen glass, and then read by the scanner 12 in a state in which the document is covered by the document cover 30.

The operation panel 40 is for operating the printer section 11 and the scanner section 12. The operation panel 40 includes various operational buttons and a liquid crystal display portion. A user can input, through the operation panel 40, commands for performing settings and operations of the various functions. For example, the user can input, through the operation panel 40, commands for performing a setting of a type of the recording sheet (i.e., a plain paper or a postcard), a setting of a one-sided recording mode (operation) in which the image is recorded only on the front surface of the recording sheet, a setting of a two-sided recording mode (operation) in which the images are recorded on the front and back surfaces of the recording sheet, and a setting of a resolution (i.e., a setting for selecting a draft mode or a photo mode).

Various small-sized memory cards each as a storage medium can be mounted into the slot portion 43. For example, image data stored in one of the memory cards can be read by an operation of the user in a state in which the memory card is mounted in the slot portion 43. Thus, the image or images can be recorded on the recording sheet on the basis of the read image data.

Figure 2:
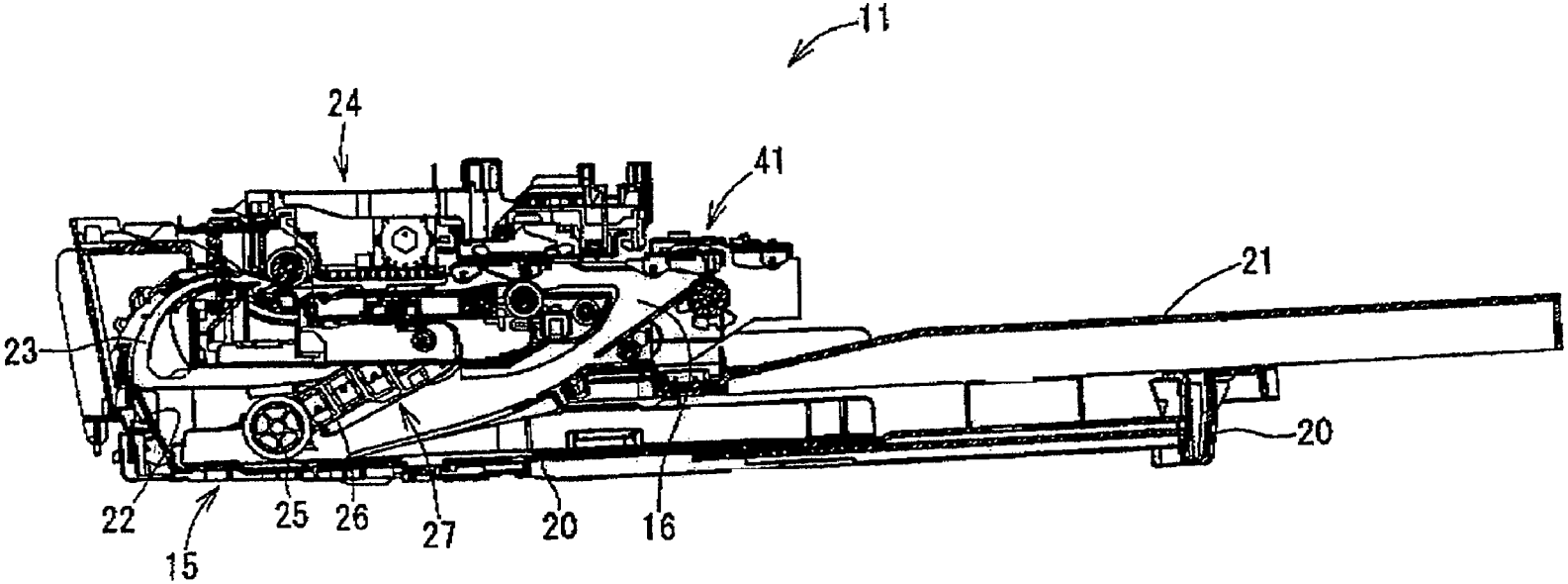
FIG. 2 is a side elevational view showing a structure of a printer section of the MFD in vertical cross section.

There will be next explained a structure of the printer section 11 with reference to FIG. 2. The printer section 11 mainly includes a sheet-supply portion 15, a sheet-transfer path 23, a recording portion 24, the sheet-discharge tray 21, a path-switching portion 41, and a sheet-return path 16. The sheet-supply portion 15 is for supplying each recording sheet to the sheet-transfer path 23. The recording sheet supplied from the sheet-supply portion 15 is transferred through the sheet-transfer path 23. The recording portion 24 records, by ejecting ink as ink droplets, the image or images on each recording sheet transferred through the sheet-transfer path 23. Each recording sheet on which the image or images is or are recorded is discharged onto the sheet-discharge tray 21. The path-switching portion 41 is provided between the sheet-discharge tray 21 and the recording portion 24 and is for switching routes through which the recording sheet is transferred, in order to record the image on the back surface of the recording sheet. The sheet-return path 16 is for guiding the recording sheet which is transferred through a selected one of the routes, toward the sheet-supply portion 15 and the sheet-transfer path 23.

Figure 3:
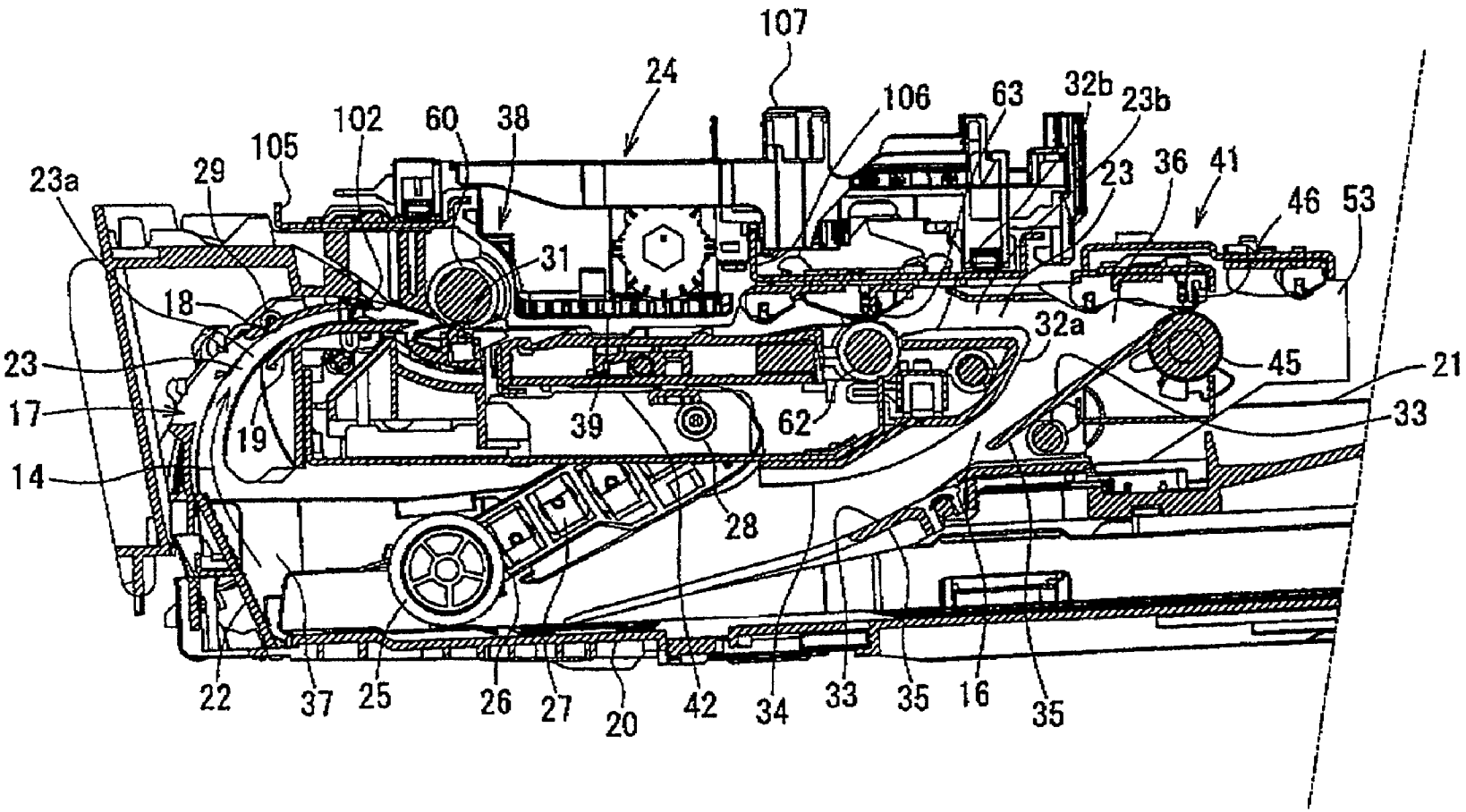
FIG. 3 is a partially enlarged view of the printer section.

The sheet-supply tray 20 which can accommodate the plurality of recording sheets stacked on each other is provided in the sheet-supply portion 15. The sheet-supply tray 20 is disposed in a bottom portion of the printer section 11 and has a box-like shape opening upward. Each of the recording sheets stacked on the sheet-supply tray 20 is supplied to the sheet-transfer path 23 by a sheet-supply roller 25. The sheet-transfer path 23 includes, as shown in FIG. 3, as a portion thereof, a sheet-supply path 23*a* which is provided between the sheet-supply roller 25 and a recording head 39 described below. The sheet-supply path 23*a* has a U-shape, and the recording sheet is transferred through the sheet-supply path 23*a* such that one of surfaces thereof opposite to the other of the surfaces contacted by the sheet-supply roller 25 faces the recording head 39.

When the image is recorded (that is, an image recording operation is performed) only on the front surface of the recording sheet, that is, the one-sided recording operation is performed, the recording sheet supplied by the sheet-supply roller 25 is guided along the sheet-supply path 23*a* so as to make an upward U-turn, and then reaches the recording portion 24. After the image is recorded on the front surface of the recording sheet by the recording portion 24, the recorded recording sheet is discharged onto the sheet-discharge tray 21.

When the images are recorded on the front and back surfaces of the recording sheet (that is, the image recording operation is performed on each of the front and back surfaces), that is, the two-sided recording operation is performed, the recording sheet whose front surface has been subjected to the image recording operation is guided by the path-switching portion 41 to the sheet-return path 16 such that the front surface of the recording sheet is to be brought into contact with the sheet-supply roller 25. Then, the sheet-supply roller 25 supplies the recording sheet to the sheet-supply path 23*a* again. After the image is recorded on the back surface of the recording sheet by the recording portion 24, the recorded recording sheet is discharged onto the sheet-discharge tray 21.

There will be next explained a structure of the printer section 11 with reference to FIG. 3 in detail. In the sheet-supply portion 15, the sheet-supply roller 25 is disposed on the sheet-supply tray 20. The sheet-supply roller 25 contacts an uppermost one of the recording sheets stacked on the sheet-supply tray 20 so as to transfer the uppermost recording sheet for supplying the uppermost recording sheet to the recording head 39 included in the recording portion 24. The sheet-supply roller 25 is rotatably supported at a distal end of a sheet-supply arm 26. The sheet-supply roller 25 is driven to be rotated by an LF motor 71 (shown in FIG. 9) as a drive source thereof via a drive-power transmitting mechanism 27. The drive-power transmitting mechanism 27 includes a plurality of gears which are linearly arranged and each of which is meshed with an adjacent one or ones of the gears.

The sheet-supply arm 26 is supported at a proximal end thereof by a pivotal shaft 28 so as to be pivotable about the pivotal shaft 28 defining a pivotal axis. Thus, the sheet-supply arm 26 is pivotable upward and downward so as to move toward and away from the sheet-supply tray 20. The sheet-supply arm 26 is forced so as to pivot downward by a self-weight thereof or by a force of a spring or the like. Thus, the sheet-supply arm 26 normally contacts the sheet-supply tray 20, and when the sheet-supply tray 20 is inserted into and pulled out of the MFD 10, the sheet-supply arm 26 is retracted to an upper position thereof. It is noted that the sheet-supply arm 26 is pivotable about the proximal end thereof, thereby improving resupplying of the recording sheet because the sheet-supply roller 25 meshes with the recording sheet more easily.

When the recording sheet is supplied from the sheet-supply tray 20, the sheet-supply roller 25 is rotated in a state in which the sheet-supply roller 25 is held in pressing contact with the uppermost one of the recording sheets on the sheet-supply tray 20, with the sheet-supply arm 26 forced so as to pivot downward. Then, the uppermost recording sheet is transferred toward a slant sheet separator plate 22 owing to a friction force between a roller surface of the sheet-supply roller 25 and the recording sheet.

When the transferred recording sheet abuts at its leading end on the slant sheet separator plate 22, the transferred recording sheet is guided upward so as to be transferred into the sheet-supply path 23*a* in a direction indicated by arrow 14. When the uppermost recording sheet is transferred by the sheet-supply roller 25, the recording sheet immediately below the uppermost recording sheet may be transferred together with the uppermost recording sheet by friction or static electricity. However, the recording sheet transferred together with the uppermost recording sheet is prevented from being transferred by abutting contact with the slant sheet separator plate 22.

The sheet-supply path 23*a* in the sheet-transfer path 23 extends upward from the slant sheet separator plate 22, and then extends from a back side (i.e., a left side of FIG. 3) toward a front side (i.e., a right side of FIG. 3) of the MFD 10 while making a U-turn in a lateral direction. Then, the sheet-transfer path 23 finally reaches the sheet-discharge tray 21 via the recording portion 24.

The sheet-transfer path 23 is defined by an outer guide face and an inner guide face, except a portion thereof where the image recording portion 24 and so on are disposed. For example, a curved portion 17 of the sheet-supply path 23*a* which is located nearer to the back side of the MFD 10 is defined by an outer guide member 18 and an inner guide member 19 which are fixed to a frame 53. In this structure, the outer guide member 18 defines as the outer guide face, and the inner guide member 19 defines as the inner guide face. The outer guide member 18 and the inner guide member 19 are disposed so as to face each other with a prescribed distance interposed therebetween.

Rotatable guide rollers 29 are provided at the curved portion 17 of the sheet-supply path 23*a*. Roller surfaces of the respective guide rollers 29 are exposed from the outer guide surface. Thus, the guide rollers 29 assure smooth transferring of the recording sheet contacting the outer guide surface at the curved portion 17 of the sheet-supply path 23*a*.

The recording portion 24 is disposed in the sheet-transfer path 23 and includes a carriage 38 and the recording head 39. The recording head 39 is mounted on the carriage 38 and is reciprocated along guide rails 105, 106 in a main scanning direction (in a direction perpendicular to the sheet surface of FIG. 3.

Specifically, the carriage 38 is slid by a CR motor 95 (shown in FIG. 9) as a drive source thereof via a belt driving mechanism, for example. It is noted that ink cartridges, not shown, are disposed in the MFD 10, independently of the recording head 39. Ink is supplied from the ink cartridges to the recording head 39 via respective ink tubes. Then, while the carriage 38 is reciprocated, the ink is ejected as fine ink droplets from the recording head 39. Thus, the images are recorded on the recording sheet transferred on a platen 42.

On the frame 53 of the MFD 10, there is provided a linear encoder 85 (shown in FIG. 9) for detecting a position of the carriage 38. An encoder strip of the linear encoder 85 is disposed on the guide rails 105, 106. The encoder strip includes light transmitting portions each of which transmits light and light intercepting portions each of which intercepts light. The light transmitting portions and the light intercepting portions are alternately arranged at predetermined pitches in a longitudinal direction of the encoder strip so as to form a predetermined pattern.

An optical sensor 107 of a transmission type is provided on an upper surface of the carriage 38. The optical sensor 107 is provided at a position corresponding to the encoder strip. The optical sensor 107 reciprocates together with the carriage 38 in the longitudinal direction of the encoder strip. During the reciprocation, the optical sensor 107 detects the pattern of the encoder strip.

On the carriage 38, there is provided a media sensor 86 (shown in FIG. 9) for detecting presence and absence of the recording sheet on the platen 42. The media sensor 86 includes a light-emitting device and a light-receiving element. Light emitted from the light-emitting device is radiated to the recording sheet transferred on the platen 42. Where the recording sheet is not transferred onto the platen 42, the light is radiated to the platen 42. The light radiated to the recording sheet or the platen 42 is reflected, and the reflected light is received by the light-receiving element. The media sensor outputs a signal according to an amount of the received light.

On an upstream side of the recording portion 24 in the sheet-transfer path 23, a sheet-feed roller 60 and a pinch roller 31 are provided as a pair. The pinch roller 31 is disposed so as to be held in pressing contact with a lower portion of the sheet-feed roller 60. The sheet-feed roller 60 and the pinch roller 31 are for feeding each recording sheet transferred in the sheet-supply path 23*a*, onto the platen 42 while nipping each recording sheet.

On a downstream side of the recording portion 24 in the sheet-transfer path 23, a sheet-discharge roller 62 and spur rollers 63 are provided. The sheet-discharge roller 62 and the spur rollers 63 are for transferring each recorded recording sheet, while nipping each recorded recording sheet, toward a downstream side of the MFD 10 through the sheet-transfer path 23 in a direction along the sheet-transfer path 23 (hereinafter may be referred to as a sheet transferring direction).

The sheet-feed roller 60 and the sheet-discharge roller 62 are driven by the LF motor 71 as drive sources thereof. The sheet-feed roller 60 and the sheet-discharge roller 62 are driven so as to be synchronized with each other and intermittently driven during the image recording operation. Thus, the image recording operation is performed while each recording sheet is fed at a suitable line feed pitch.

Figure 9:
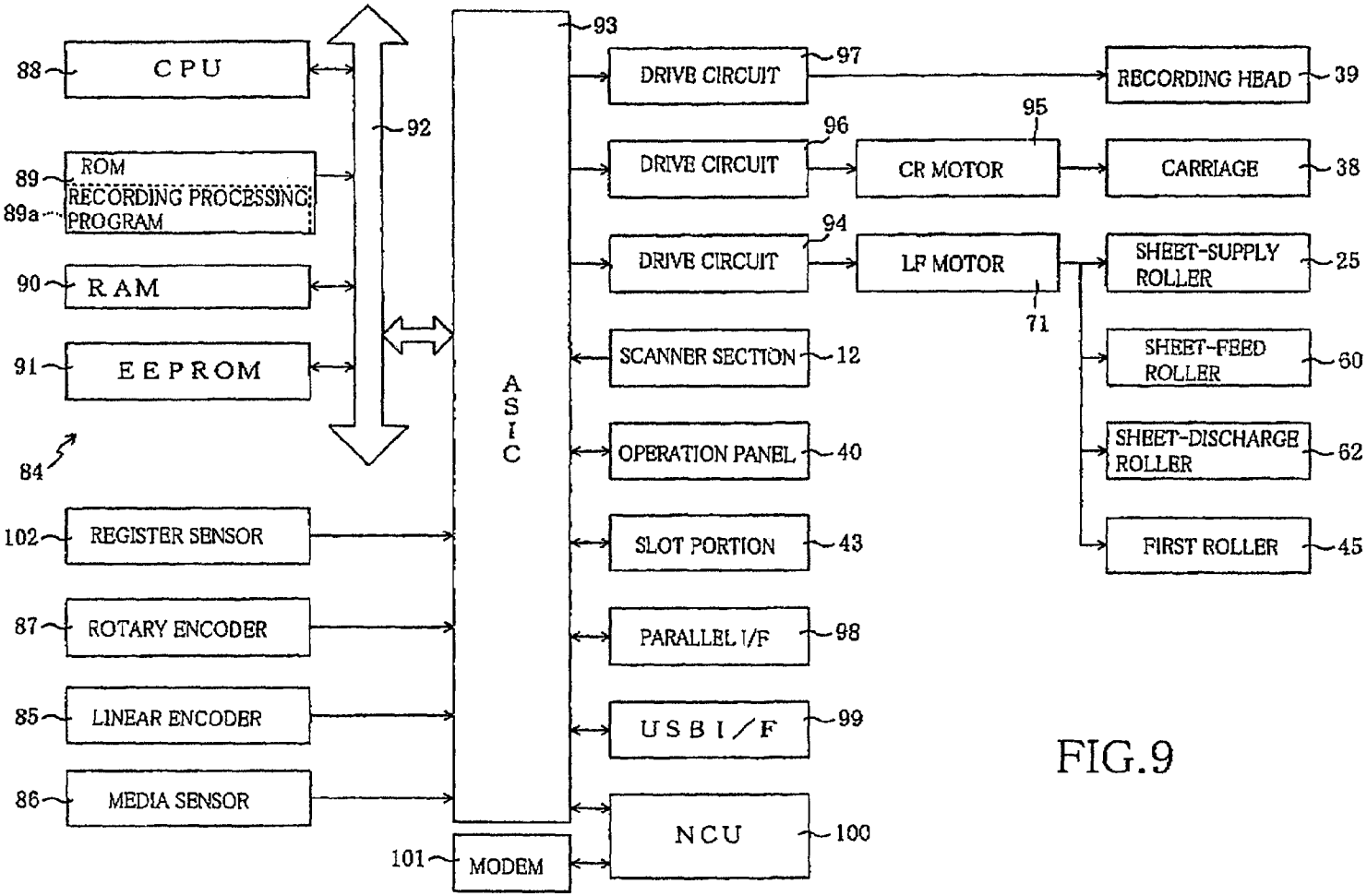
FIG. 9 is a block diagram showing a configuration of a controller of the MFD.

It is noted that the sheet-feed roller 60 is provided with a rotary encoder 87 (shown in FIG. 9). The rotary encoder 87 detects, by an optical sensor, a pattern of an encoder disk (not shown) which is rotated together with the sheet-feed roller 60. On the basis of signals detected by the optical sensor, respective rotations of the sheet-feed roller 60 and the sheet-discharge roller 62 are controlled. Before and after the image recording operation, the sheet-feed roller 60 and the sheet-discharge roller 62 are constantly driven, thereby realizing a speedy transferring of each recording sheet.

The spur rollers 63 are brought into pressing contact with each recorded recording sheet. A roller surface of each of the spur rollers 63 has a plurality of projections and depressions like a spur so as not to deteriorate the image recorded on the recording sheet. The spur rollers 63 are provided so as to be slidable and movable toward and away from the sheet-discharge roller 62. The spur rollers 63 are forced so as to be brought into pressing contact with the sheet-discharge roller 62. It is noted that coil springs are typically employed as means for forcing the spur rollers 63 to the sheet-discharge roller 62.

Although not shown in FIG. 3, in this MFD 10, the spur rollers 63 are arranged so as to be equally spaced in a direction perpendicular to the sheet transferring direction, that is, in a widthwise direction of each recording sheet. The number of the spur rollers 63 is not particularly limited, but this MFD 10 includes eight spur rollers 63.

When each recording sheet is transferred into between the sheet-discharge roller 62 and the spur rollers 63, the spur rollers 63 are retracted against forces of coil springs by a distance corresponding to a thickness of the recording sheet. Each recording sheet is pressed onto the sheet-discharge roller 62. Thus, a rotational force of the sheet-discharge roller 62 is reliably transmitted to each recording sheet. The pinch roller 31 is elastically forced to the sheet-feed roller 60 in a similar manner. Thus, each recording sheet is pressed onto the sheet-feed roller 60, whereby a rotational force of the sheet-feed roller 60 is reliably transmitted to each recording sheet.

A register sensor 102 (shown in FIG. 9) is disposed on an upstream side of the sheet-feed roller 60 in the sheet-transfer path 23. The register sensor 102 includes a detecting piece and an optical sensor. The detecting piece is disposed across the sheet-transfer path 23 and can project into and retract from the sheet-transfer path 23. Normally, the detecting piece is elastically forced so as to project into the sheet-transfer path 23. Each recording sheet being transferred in the sheet-transfer path 23 is brought into contact with the detecting piece, whereby the detecting piece retracts from the sheet-transfer path 23. The projection and retraction of the detecting piece change an "ON" state and an "OFF" state of the optical sensor. Thus, each recording sheet causes the detecting piece to project and retract, whereby the leading end and a trailing end of each recording sheet in the sheet-transfer path 23 are detected.

Figure 4:
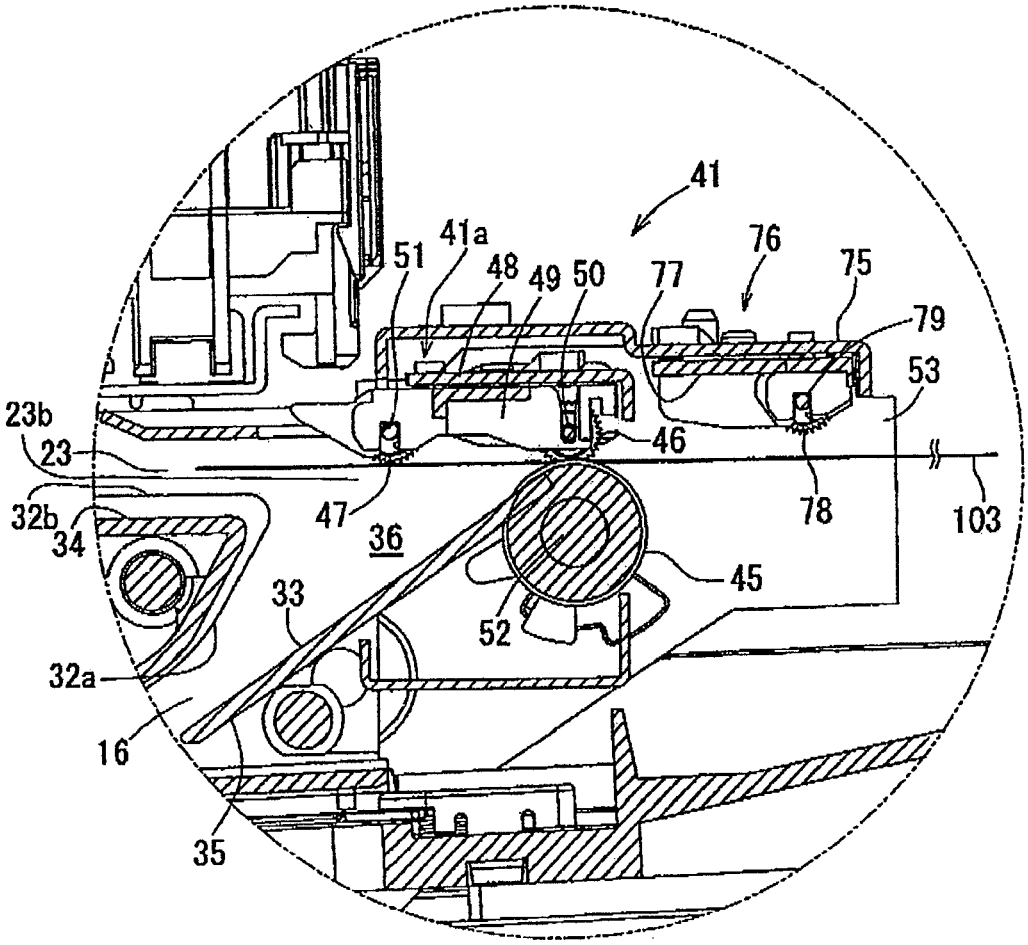
FIG. 4 is an enlarged cross sectional view showing a part of the MFD which includes a path-switching member, in a state in which the path-switching member takes a recording sheet discharged posture.
Figure 5:
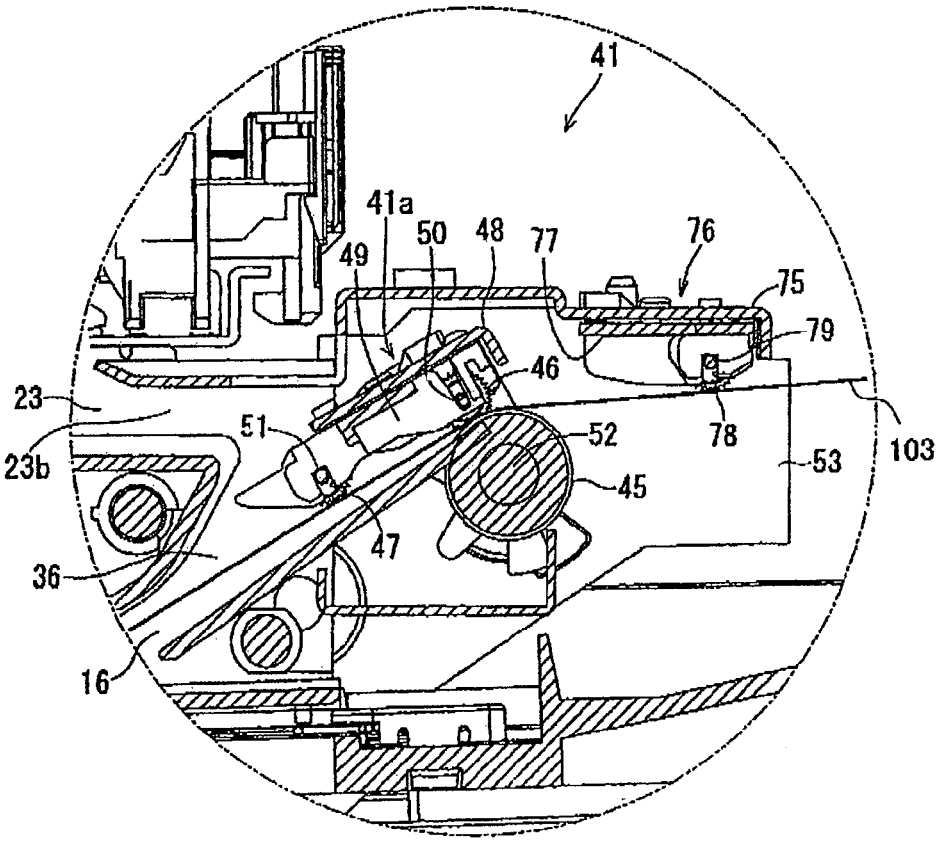
FIG. 5 is an enlarged cross sectional view of the part of the MFD which includes the path-switching member, in a state in which the path-switching member takes a recording sheet reversed posture.

There will be next explained the path-switching portion 41 with reference to FIGS. 4 and 5. The path-switching portion 41 is disposed on a downstream side of the recording portion 24 in the sheet transferring direction. More specifically, the path-switching portion 41 is disposed in a downstream portion 36 of the sheet-transfer path 23 which is located downstream of the recording portion 24, that is, the path-switching portion 41 is disposed on an downstream side, in the sheet transferring direction, of a boundary portion between the sheet transfer path 23 and the sheet-return path 16. The path-switching portion 41 is provided with a first roller 45 and second rollers 46 as a pair of sheet-transfer rollers, and auxiliary rollers 47 which are provided on respective sides of the second rollers 46. Further, the sheet-transfer path 23 includes a connecting path 23*b* that connects the first and second rollers 45, 46 and the recording head 39.

The first roller 45 and the second rollers 46 are disposed on a downstream side of the recording head 39 so as to be rotatable forwardly and reversely. The first roller 45 and the second rollers 46 transfer the recording sheet 103 passed or transferred through the recording head 39 by the sheet-discharge roller 62 and the spur rollers 63 while nipping the recording sheet 103. The first roller 45 and the second rollers 46 can transfer the recording sheet 103 passed through the recording head 39 in the connecting path 23*b* to a further downstream side in the sheet transferring direction (that is, toward the sheet-discharge tray 21 and an outside of the MFD 10). Further, the first roller 45 and the second rollers 46 can transfer the recording sheet 103 to the sheet-return path 16 and to the sheet-supply roller 25 such that the recording sheet 103 is permitted to be again supplied to the recording head 39 by the sheet-supply roller 25.

Figure 6:
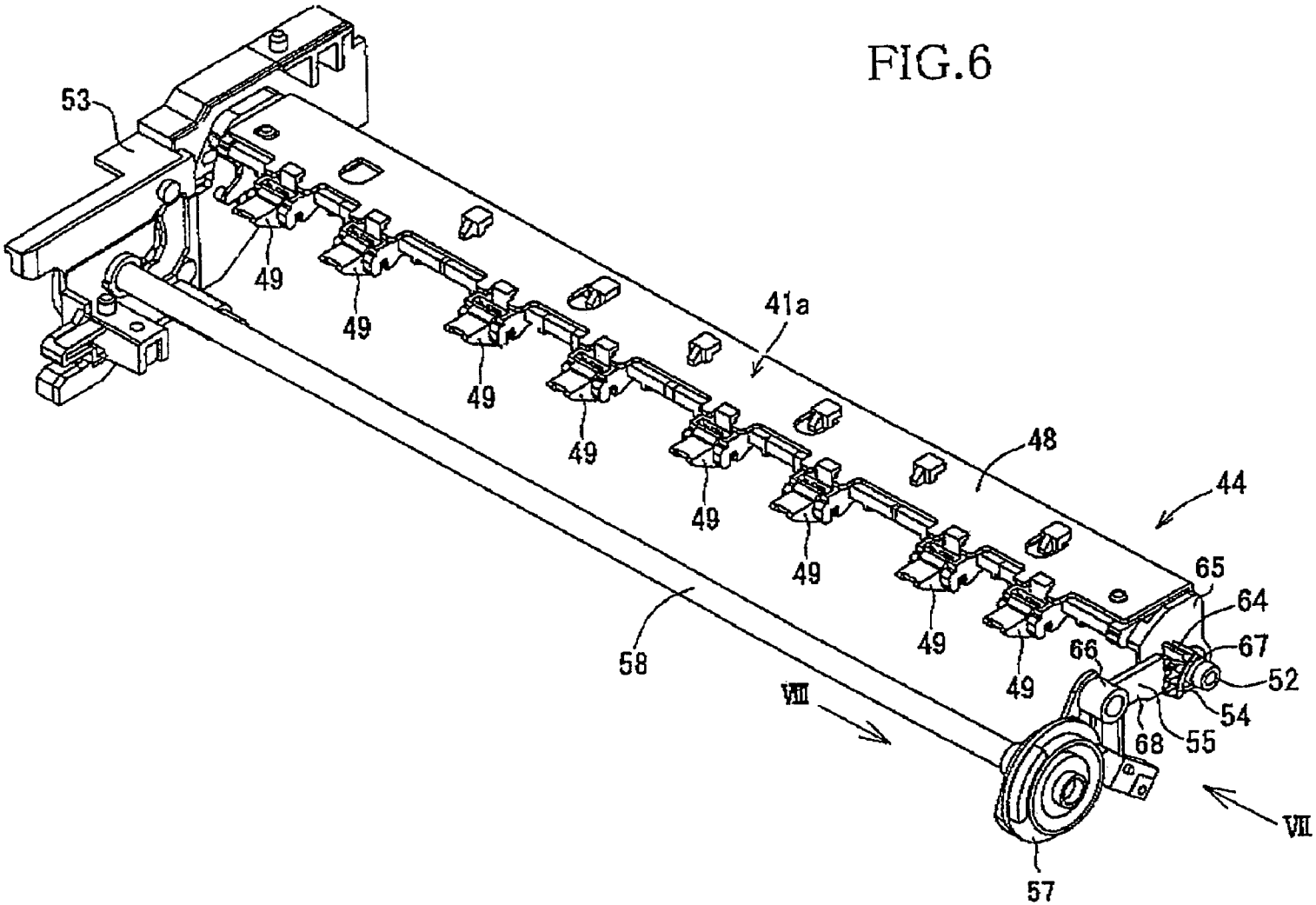
FIG. 6 is a perspective view of the path-switching member.

The second rollers 46 and the auxiliary rollers 47 are attached to a frame 48. As shown in FIG. 6, the frame 48 extends in a right and left direction of the MFD 10 (in a direction perpendicular to a sheet surface of FIG. 3). The frame 48 has a generally-L-shaped cross section, thereby assuring a required flexural rigidity of the frame 48.

The frame 48 includes eight sub-frames 49 (shown in FIG. 6) formed integrally with the frame 48. The sub-frames 49 are arranged so as to be symmetric with respect to a center of the MFD 10 in the right and left direction. Each of the sub-frames 49 supports a corresponding one of the second rollers 46 and a corresponding one of the auxiliary rollers 47. Consequently, the frame 48 includes the eight second rollers 46 and the eight auxiliary rollers 47. The second rollers 46 and the auxiliary rollers 47 are arranged so as to be equally spaced in the direction perpendicular to the sheet transferring direction, that is, in a widthwise direction of the recording sheet 103.

The sub-frames 49 are provided with support shafts 50, 51. The second rollers 46 are supported by the support shaft 50 so as to be rotatable about the support shaft 50. The &urinary rollers 47 are supported by the support shaft 51 so as to be rotatable about the support shaft 51. In this MFD 10, each of the second rollers 46 and the auxiliary rollers 47 is provided by a spur roller. The auxiliary rollers 47 are disposed on an upstream side of the second rollers 46 in the sheet transferring direction by a specific distance. The second rollers 46 are forced downward by springs, not shown, so as to be normally and elastically pressed onto the first roller 45.

The first roller 45 is linked to the LF motor 71 via a drive-power transmitting mechanism so as to be driven to be rotated by drive power of the LF motor 71. The first roller 45 has a central shaft 52. The central shaft 52 is supported by the frame 53.

The second rollers 46 are disposed on an upper side of the first roller 45. The first roller 45 may have an elongated cylindrical shape and may be provided by eight rollers respectively opposed to the second rollers 46.

It is noted that the first roller 45 is forwardly and reversely rotated by the LF motor 71 so as to transfer each recording sheet toward the sheet-discharge tray 21 or toward the sheet-return path 16. On the other hand, each of the second rollers 46 is a driven roller that is rotated in accordance with the rotation of the first roller 45. That is, the recording sheet 103 transferred in the connecting path 23*b* is nipped by the first roller 45 and the second rollers 46 in a state in which the second rollers 46 contact a surface of the recording sheet 103 that has faced the recording head 39 when the recording sheet 103 has been transferred through the recording head 39. Then, when the first roller 45 is forwardly rotated, the recording sheet 103 is transferred downstream in the sheet transferring direction while being nipped by the first roller 45 and the second rollers 46, and then the recording sheet 103 is discharged onto the sheet-discharge tray 21. When the first roller 45 is reversely rotated, the recording sheet 103 is transferred or returned upstream in the sheet transferring direction while being nipped by the first roller 45 and the second rollers 46.

In this MFD 10, an outer diameter of the first roller 45 is set to be slightly larger than that of the sheet-discharge roller 62. That is, when the first roller 45 and the sheet-discharge roller 62 are rotated at the same rotational speed, a peripheral speed of the first roller 45 is faster than that of the sheet-discharge roller 62. Thus, when the recording sheet 103 is transferred by both of the sheet-discharge roller 62 and the first roller 45, the recording sheet 103 is normally tensioned in the sheet transferring direction.

In view of the above, the path switching portion 41 has a path-switching member 41*a*, as a movable member, constituted by including the frame 48, the sub-frames 49, and the auxiliary rollers 47. The path-switching member 41*a* supports, at a proximal end portion thereof, the second rollers 46 such that the second rollers 46 are rotatable, extends upstream in the connecting path 23*b*, and is movable about a rotation axis of the first roller 45. Further, the path-switching member 41*a* introduces, into the sheet-return path 16, one of opposite ends of the recording sheet 103 being nipped by the first roller 45 and the second rollers 46, which one end is nearer to the recording head 39, by contacting the recording sheet 103 at a distal end portion of the path-switching member 41*a*. In other words, the path-switching member 41*a* has, at the distal end portion thereof, the auxiliary rollers 14 which contact the recording sheet 103, thereby smoothly transferring each recording sheet.

Here, there will be explained a drive mechanism 44 of the path-switching portion 41 with reference to FIGS. 6 to 8. The drive mechanism 44 is for driving the path-switching member 41*a* to change from a state shown in FIG. 4 to a state shown in FIG. 5, and for driving the path-switching member 41*a* to return from the state shown in FIG. 5 to the state shown in FIG. 4.

As shown in FIG. 6, the drive mechanism 44 includes a driven gear 54 provided on the central shaft 52, a drive gear 55 meshable with the driven gear 54, and a cam 57 engaging the drive gear 55.

The cam 57 is connected to one of opposite ends of a rotation driving shaft 58. The rotation driving shaft 58 is driven by the drive power of the LF motor 71. As shown in FIG. 8, a guide groove 69 is formed in the cam 57. The guide groove 59 is generally annular about the rotation driving shaft 58. Specifically, the guide groove 59 has a small arc portion 69, a large arc portion 70, a connecting portion 72, and a connecting portion 73. The small arc portion 69 and the large arc portion 70 are centered about the rotation driving shaft 58. The connecting portion 72 connects one end of the small arc portion 69 and one end of the large arc portion 70. The connecting portion 73 connects the other end of the small arc portion 69 and the other end of the large arc portion 70.

Figure 7:
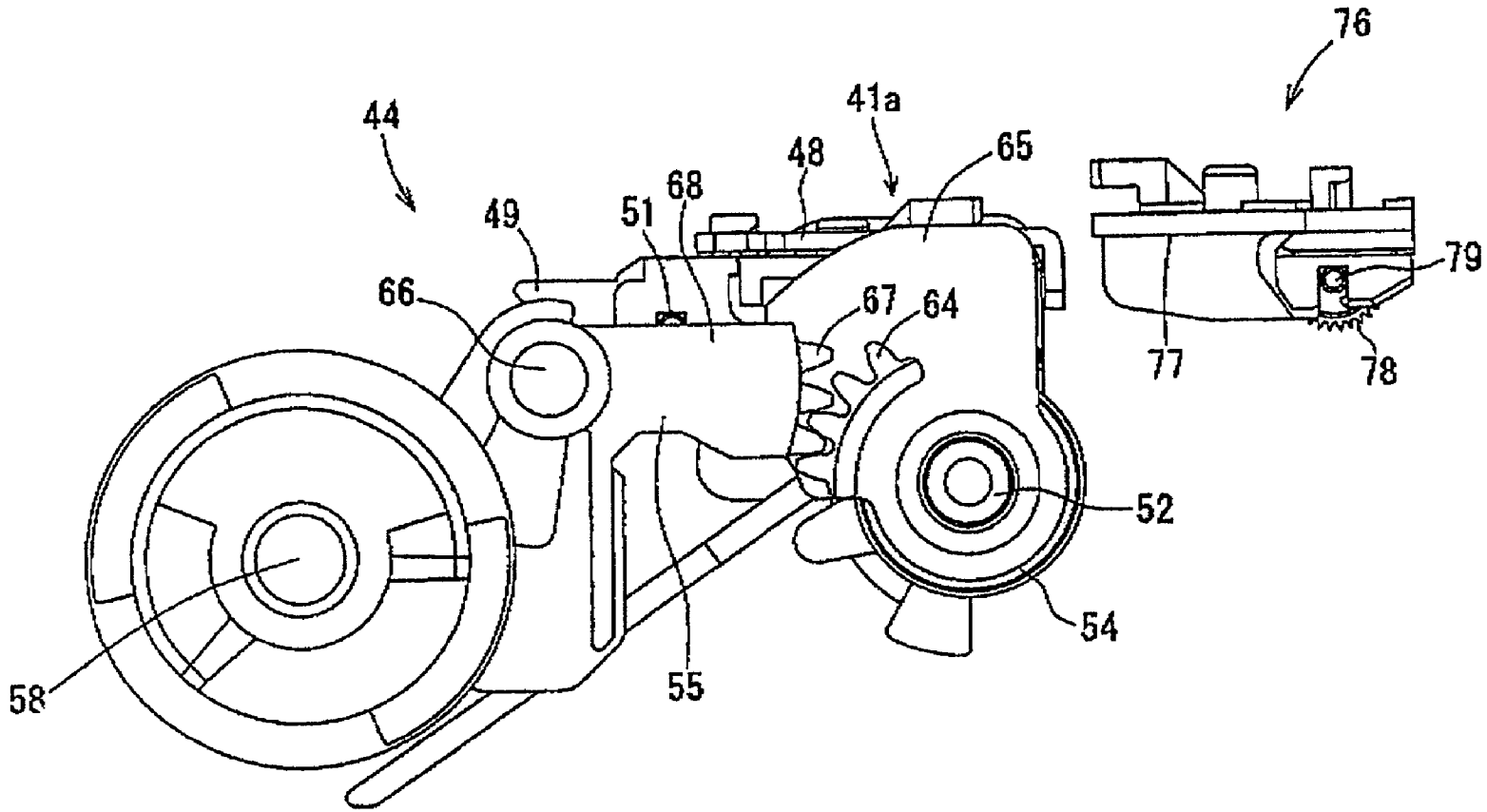
FIG. 7 is a view of the path-switching member as viewed in a direction indicated by arrow VII in FIG. 6.

As shown in FIGS. 6 and 7, the driven gear 54 includes a toothed portion 64 and a flange portion 65. The toothed portion 64 is provided as an involute gear centered about the central shaft 52. The toothed portion 64 is fitted on the central shaft 52 so as to be rotatable about the central shaft 52. The flange portion 65 is formed integrally with the toothed portion 64 and connected to the frame 48. Thus, when the toothed portion 64 is rotated, the frame 48, the sub-frames 49, the second rollers 46, and the auxiliary rollers 47 are rotated together with each other about the central shaft 52. That is, the path-switching member 41*a* and the second rollers 46 are pivoted together with each other about the central shaft 52.

The drive gear 55 is rotatably supported by a support shaft 66. The support shaft 66 is provided on the frame 53. The drive gear 55 includes a toothed portion 67 and an arm 68. The toothed portion 67 is provided as an involute gear centered about the support shaft 66 and meshed with the toothed portion 64. A pin 56 shown in FIG. 8 is provided on the arm 68 so as to be projected from the arm 68. The pin 56 is fitted in the guide groove 59 so as to be slidable along the guide groove 59. A rotation of the toothed portion 67 causes the toothed portion 64 to be rotated. As a result, the frame 48, the sub-frames 49, the second rollers 46, and the auxiliary rollers 47 are rotated together with each other about the central shaft 52. That is, the path-switching member 41*a* and the second rollers 46 are pivoted together with each other about the central shaft 52.

Figure 8:
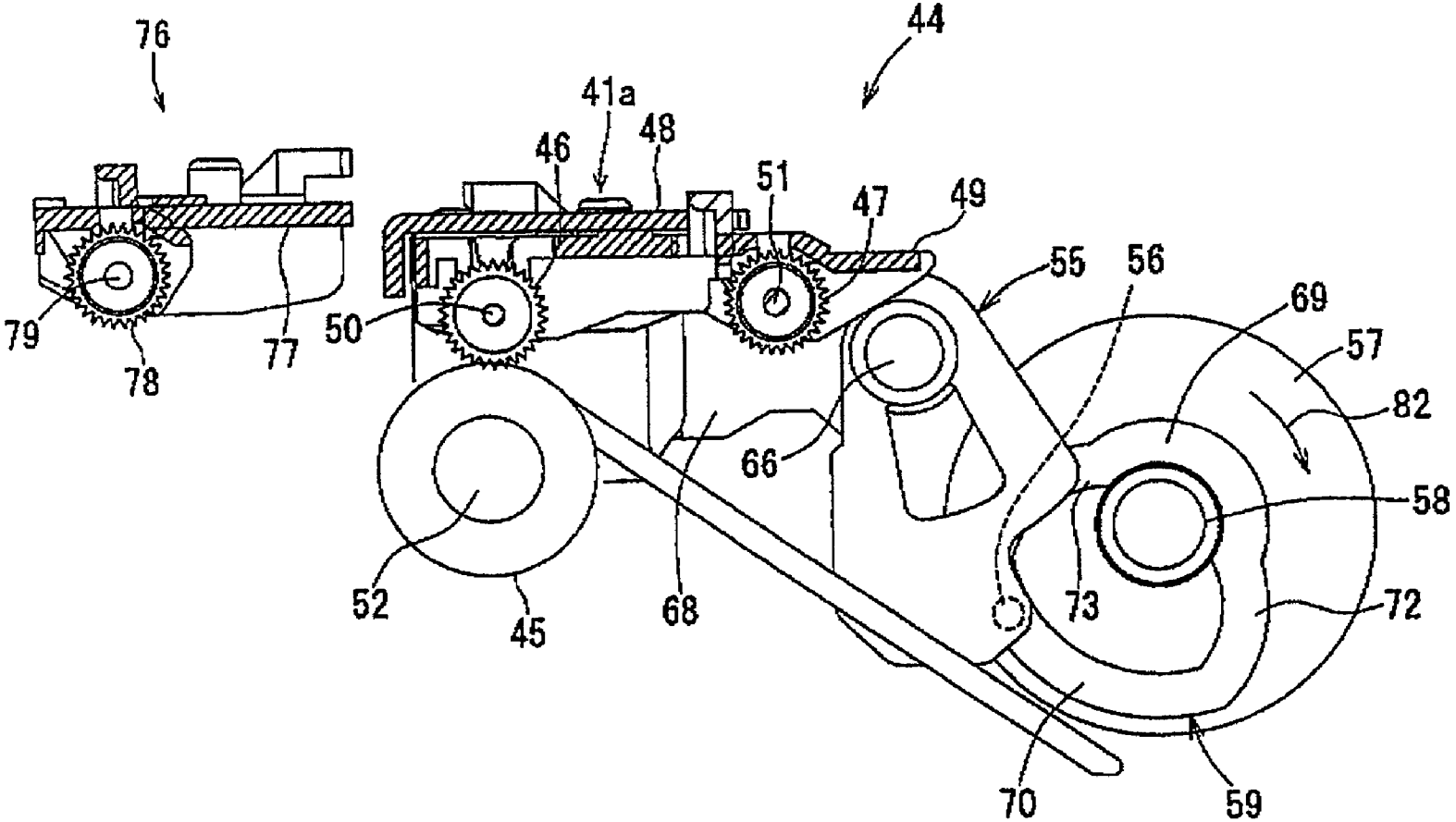
FIG. 8 is a view of the path-switching member as viewed in a direction indicated by arrow VIII in FIG. 6.

As shown in FIG. 8, when the cam 57 is rotated, the pin 56 is moved relative to the cam 57 along the guide groove 59. In particular, when the pin 56 is slid along the connecting grooves 72, 73, the pin 56 is moved in a radial direction of the cam 57. Thus, when the cam 57 is rotated in a clockwise direction indicated by arrow 82 in FIG. 8, the pin 56 is moved to the large arc portion 70, the connecting portion 72, and the small arc portion 69 in order.

Thus, the drive gear 55 is rotated in the clockwise direction in FIG. 7. As a result, the driven gear 54 is rotated about the central shaft 52 in the counterclockwise direction in FIG. 7. As described above, the driven gear 54 is connected to the frame 48. Thus, a rotation of the driven gear 54 causes the frame 48, the sub-frames 49, the second rollers 46, and the auxiliary rollers 47 to be rotated together with each other about the central shaft 52 as shown in FIG. 5. That is, the path-switching member 41*a* and the second rollers 46 are pivoted together with each other about the central shaft 52. It is noted that, in this state, when the cam 57 is rotated in the counterclockwise direction, the frame 48, the sub-frames 49, the second rollers 46, and the auxiliary rollers 47 are rotated together with each other about the central shaft 52 so as to return to their original state as shown in FIG. 4.

In this MFD 10, a posture of the path-switching member 41*a* shown in FIG. 4 is referred to as a recording sheet discharged posture while a posture of the path-switching member 41*a* shown in FIG. 5 is referred to as a recording sheet reversed posture. When only the front surface of the recording sheet is subjected to the image recording operation (that is, the one-sided recording operation is performed), the path-switching member 41*a* always takes the recording sheet discharged posture as shown in FIG. 4, and each recording sheet transferred in the sheet-transfer path 23 is transferred toward the sheet-discharge tray 21.

As shown in FIG. 5, when the path-switching member 41*a* is changed to the recording sheet reversed posture, the recording sheet 103 is guided to the sheet-return path 16. More specifically, when each of the front and back surfaces of the recording sheet is subjected to the image recording operation (that is, the two-sided recording operation is performed), the path-switching member 41*a* initially maintains the recording sheet discharged posture (as shown in FIG. 4), and the recording sheet whose front surface has been subjected to the image recording operation is transferred downward in the sheet transferring direction. Thereafter, the path-switching member 41*a* is changed from the recording sheet discharged posture (shown in FIG. 4) to the recording sheet reversed posture (shown in FIG. 5), and the auxiliary rollers 47 (the distal end portion of the path-switching member 41*a*) guide the recording sheet 103 toward the sheet-return path 16 while pressing the recording sheet 103.

As shown in FIG. 4, a guide portion 76 is disposed on a downstream side of the path-switching portion 41 constructed as described above. The guide portion 76 is provided on a downstream side of the first roller 45 and the second rollers 46 in the sheet transferring direction. A support plate 75 is attached to the frame 53. The support plate 75 supports the guide portion 76.

The guide portion 76 has a proximal portion 77 and guide rollers 78. The proximal portion 77 is fixed to a lower surface of the support plate 75, and the guide rollers 78 are supported by the proximal portion 77. The proximal portion 77 includes a support shaft 79. The guide rollers 78 are rotatably supported by the support shaft 79. It is noted that, in this MFD 10, each of the guide rollers 78 is formed into a spur shape.

The guide portion 76 contacts a recorded surface of the recording sheet 103 on which the image recording operation has been performed, when the recording sheet 103 is being transferred to the sheet-return path 16 by the respective reverse rotations of the first roller 45 and the second rollers 46. The guide portion 76 does not contact the recording sheet 103 when the recording sheet 103 is transferred to the sheet-discharge tray 21 by the respective forward rotations of the first roller 45 and the second rollers 46. More specifically, the guide portion 76 is provided at a position at which the guide portion 76 is distant from a phantom line connecting a contact point of the first roller 45 and the second rollers 46, and a contact point of the sheet-discharge roller 62 and the spur rollers 63.

Where the recording sheet 103 is transferred to the sheet-return path 16 in order to perform the image recording operation on the back surface of the recording sheet 103, a portion of the recording sheet 103 which is further from the recording head 39 and is located downstream of the first roller 45 and the second rollers 46 in a sheet-returning direction extending from the first roller 45 and the second rollers 46 toward the sheet-supply roller 25 is forced by rigidity of the recording sheet 103 so as to be parallel to the sheet-return path 16. However, the guide rollers 78 contact the recorded surface of the recording sheet 103, so that the recording sheet 103 is bent. As a result, the recording sheet 103 winds on the first roller 45 and the second rollers 46, whereby a stable transferring force is provided. Thus, the recording sheet 103 is reliably transferred to the sheet-return path 16.

As shown in FIG. 3, the sheet-return path 16 is connected to or communicated with the sheet-transfer path 23 and is continuous with the downstream portion 36 of the sheet-transfer path 23 which is located on the downstream side of the recording portion 24 in the sheet transferring direction. In other words, the sheet-return path 16 is branched from the connecting path 23*b* so as to extend toward the sheet-supply roller 25. The sheet-return path 16 is a path that again guides, onto the sheet-supply tray 20, the recording sheet whose front surface has been subjected to the image recording operation. The sheet-return path 16 is defined by a first lower guide face 32*a* and a second guide face 33.

In this MFD 10, the first lower guide face 32*a* and a first upper guide face 32*b*, and the second guide face 33 are respectively provided by a surface of a guide member 34 and a surface of a guide member 35. The guide member 34 and the guide member 35 are disposed in the frame 53 of the MFD 10. The guide members 34, 35 are disposed so as to face each other with a certain distance interposed therebetween. The first lower guide face 32*b* and the second guide face 33 extend obliquely downward from the downstream portion 36 of the sheet-transfer path 23 toward the sheet-supply roller 25.

In view of the above, the first upper guide face 32*b* of the guide member 34 which faces the connecting path 23*b*, that is, which defines the connecting path 23*b* can be considered to constitute a sheet guide disposed in the connecting path on an upstream side of the path-switching portion 41 and the sheet-return path 16 and on a downstream side of the recording head 39, and configured to support the recording sheet 103 having passed through the recording head 39.

It is noted that this MFD 10 is configured such that the sheet-return path 16 guides or returns the recording sheet 103 onto the sheet-supply tray 20, but the configuration of the MFD 10 is not limited thereto. In short, it is sufficient for the sheet-return path 16 to connect the downstream portion 36 and an upstream portion 37, that is, the sheet-supply path 23*a* of the sheet-transfer path 23. For example, it is sufficient for the recording sheet 103 to be returned to a side of the upstream portion 37 which is nearer to the sheet-supply tray 20.

There will be next explained a configuration of a controller 84 of the MFD 10 with reference to FIG. 9. The controller 84 executes controls for operations of the MFD 10 which include operations of not only the printer section 11 but also the scanner section 12, but a detailed explanation of the operation of the scanner section 12 is dispensed with.

As shown in FIG. 9, the controller 84 is constituted by a microcomputer mainly including a Central Processing Unit (CPU) 88, a Read Only Memory (ROM) 89, a Random Access Memory (RAM) 90, and an Electrically Erasable and Programmable ROM (EEPROM) 91 storing flags, settings, and the like which should be kept also after turning a power off. The control section is connected to an Application Specific Integrated Circuit (ASIC) 93 via a bus 92.

The ROM 89 stores programs and the like for controlling various operations of the MFD 10. For example, the ROM 89 stores a recording processing program 89*a* for performing a two-sided recording processing shown in FIG. 10 by the CPU 88. The RAM 90 functions as a working area or a storage area which temporarily stores various data used when the CPU 88 executes the programs.

The ASIC 93 produces, on the basis of a command from the CPU 88, a phase excitation signal and the like for energizing the LF motor 71. The signal is transmitted to a drive circuit 94 of the LF motor 71, and a drive signal is transmitted, via the drive circuit 94, to the LF motor 71 for the energization. Thus, the rotation of the LF motor 71 is controlled.

The drive circuit 94 is for driving the LF motor 71 connected to the sheet-supply roller 25, the sheet-feed roller 60, the sheet-discharge roller 62, the first roller 45, and so on. The drive circuit 94 receives an output signal from the ASIC 93 and produces an electric signal for rotating the LF motor 71. The LF motor 71 receives the electric signal and is rotated on the basis of the electric signal. A rotational force of the LF motor 71 is transmitted to the sheet-supply roller 25, the sheet-feed roller 60, the sheet-discharge roller 62, and the first roller 45 via a known drive mechanism constituted by gears and a drive shaft and so on In this MFD 10, the LF motor 71 functions as a drive source for supplying the recording sheet 103 from the sheet-supply tray 20. Further, the LF motor 71 functions as a drive source for transferring the recording sheet 103 located on the platen 42 and discharging the recorded recording sheet 103 onto the sheet-discharge tray 21. Furthermore, the LF motor 71 functions as a drive source for driving the sheet-discharge roller 62 via a specific drive-power transmitting mechanism.

That is, the LF motor 71 drives the sheet-supply roller 25 via the drive-power transmitting mechanism 27, the sheet-discharge roller 62 via the specific drive-power transmitting mechanism, and the sheet-feed roller 60. It is noted that the specific drive-power transmitting mechanism may be constituted by gear trains for example. Further, for the specific drive-power transmitting mechanism, other components such as a timing belt may be used depending upon an assembling space required for the specific drive-power transmitting mechanism.

The ASIC 93 produces, on the basis of a command of the CPU 88, a phase excitation signal and the like for energizing the CR (carriage) motor 95. The signal is transmitted to a drive circuit 96 of the CR motor 95, and a drive signal is transmitted, via the drive circuit 96, to the CR motor 95 for the energization. Thus, the rotation of the CR motor 95 is controlled.

The drive circuit 96 is for driving the CR motor 95 connected to the carriage 38. The drive circuit 96 receives an output signal from the ASIC 93, and produces an electric signal for rotating the CR motor 95. The CR motor 95 receives the electric signal and is rotated on the basis of the electric signal. A rotational force of the CR motor 95 is transmitted to the carriage 38, so that the carriage 38 is reciprocated.

A drive circuit 97 is for driving the recording head 39 so that the recording head 39 ejects the ink onto the recording sheet 103 at suitable timings. On the basis of a drive controlling procedure outputted from the CPU 88, the drive circuit 97 receives an output signal produced by the ASIC 93 and controls the driving of the recording head 39.

To the ASIC 93, there are connected the scanner section 12, the operation panel 40 for commanding the operations of the MFD 10, the slot portion.43 into which the memory cards of various small types are inserted, a parallel interface (I/F) 98 and a USB interface (I/F) 99 each for transmitting and receiving data to and from an external device such as a personal computer via a corresponding one of a parallel cable and a USB cable, and a Network Control Unit (NCU) 100 and a modem 101 for realizing the facsimile function.

In addition, to the ASIC 93, there are connected the register sensor 102 for detecting that the recording sheet 103 has been transferred from the sheet-supply roller 25 to a vicinity of the sheet-feed roller 60, a rotary encoder 87 for detecting respective rotational amounts of the rollers driven by the LF motor 71, the linear encoder 85 for detecting an amount of the movement of the carriage 38, and the media sensor 86 for detecting the presence and the absence of the recording sheet 103 on the platen 42.

Here, there will be briefly explained processings performed by the controller 84 of the MFD 10. When the MFD 10 is turned on, the carriage 38 is temporarily moved to one of opposite ends of a range in which the carriage 38 is reciprocated, and a detecting position of the linear encoder 85 is initialized. When the carriage 38 is moved or slid from the initial position, the optical sensor 107 provided on the carriage 38 detects the pattern of the encoder strip.

The controller 84 recognizes an amount of the movement of the carriage 38 by a number of pulse signals which are based on the detection of the optical sensor 107. On the basis of the amount of the movement, the controller 84 controls the rotation of the CR motor 95 in order to control the reciprocation of the carriage 38. Further, on the basis of an output signal of the register sensor 102 and an encoded amount detected by the rotary encoder 87, the controller 84 recognizes an amount of transferring of the recording sheet 103, and a position of the leading end or a position of the trailing end of the recording sheet 103.

When the leading end of the recording sheet 103 reaches a prescribed position of the platen 42, the controller 84 controls the rotation of the LF motor 71 in order to intermittently feed the recording sheet 103 at the predetermined line transfer pitch. The line transfer pitch is set on the basis of a resolution and the like inputted as a condition of the image recording operation. In particular, where the image recording operation is performed at a high resolution, or a non-margin recording operation is performed, the controller 84 precisely detects the positions of the leading end and the trailing end of the recording sheet 103 on the basis of the detection of the presence of the recording sheet 103 by the media sensor 86 and the encoded amount detected by the rotary encoder 87.

Further, the controller 84 precisely detects respective positions of lateral opposite ends of the recording sheet 103 on the basis of the detection of the presence of the recording sheet 103 by the media sensor 86 and an encoded amount detected by the linear encoder 85. On the basis of the thus detected respective positions of the leading end, the trailing end, and the lateral ends of the recording sheet 103, the controller 84 controls the ejection of the ink as ink droplets by the recording head 39.

Figure 10:
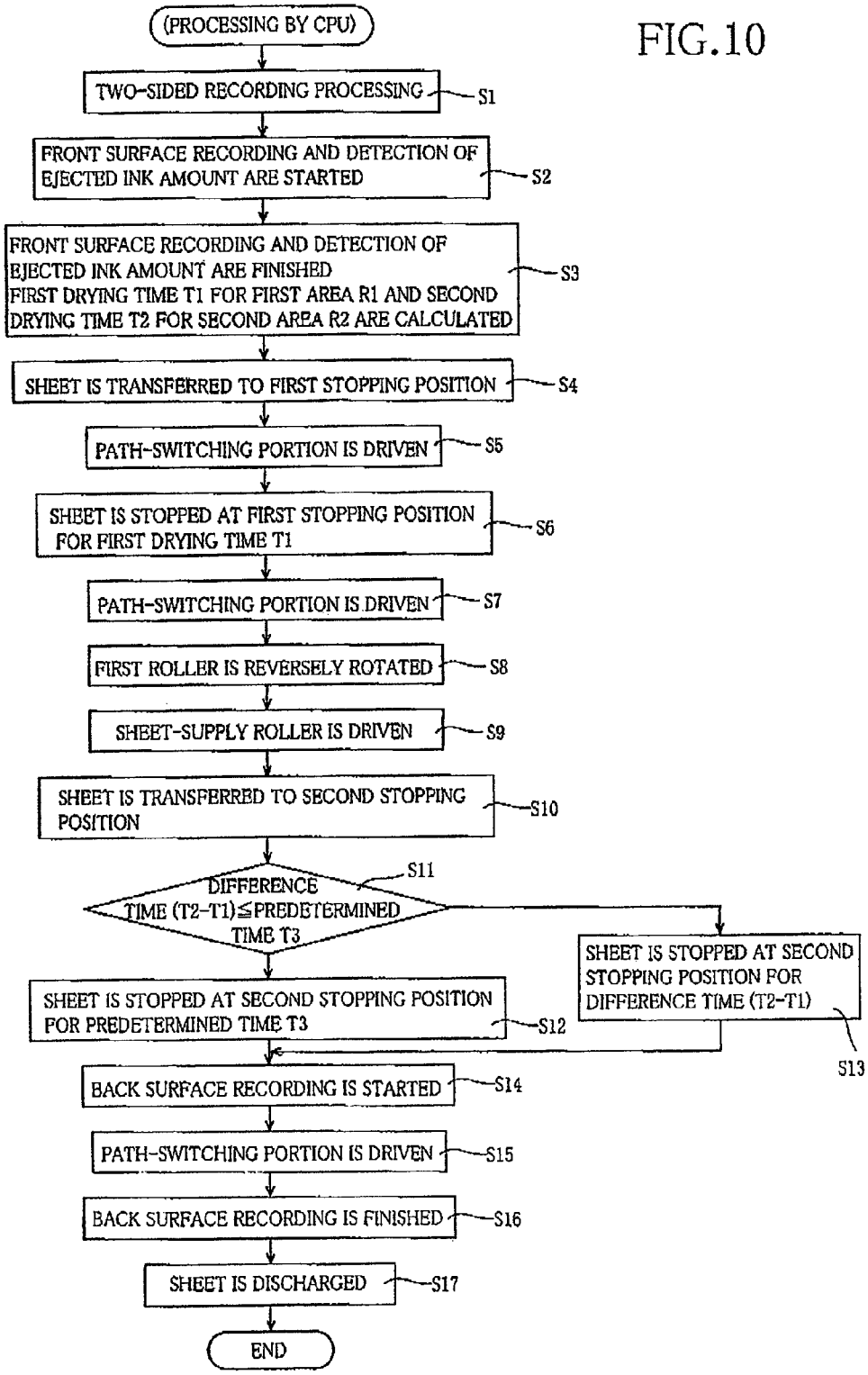
FIG. 10 is a flow-chart showing a two-sided recording processing performed by a CPU.

There will be next explained the two-sided recording processing performed by the CPU 88 of the MFD 10 with reference to FIG. 10. It is noted that, in FIG. 10, the two-sided recording processing is explained in a case where a command for starting the two-sided recording operation is inputted.

According to this two-sided recording processing, when a command for performing the two-sided recording processing is inputted, the sheet-supply roller 25 is driven, so that the recording sheet 103 is transferred from the sheet-supply tray 20 into the sheet-transfer path 23 in the direction indicated by the arrow 14. In the sheet-supply path 23*a*, the recording sheet 103 is reversed such that a surface thereof (the front surface) opposite to a surface thereof that has contacted the sheet-supply roller 25 is opposed to a nozzle surface of the recording head 39 in which nozzles are formed.

When the recording sheet 103 reaches the sheet-feed roller 60 and the pinch roller 31, the sheet-feed roller 60 and the pinch roller 31 transfer the recording sheet 103 into between the recording head 39 and the platen 42 while nipping the recording sheet 103. Then, the image recording operation is started to be performed on the front surface of the recording sheet which faces the recording head 39. Further, where the image recording operation is started to be performed on the front surface, detection of an amount of the ink ejected onto the front surface is started in S1. It is noted that the amount of the ejected ink may be referred to as an ejected ink amount.

Figure 11:
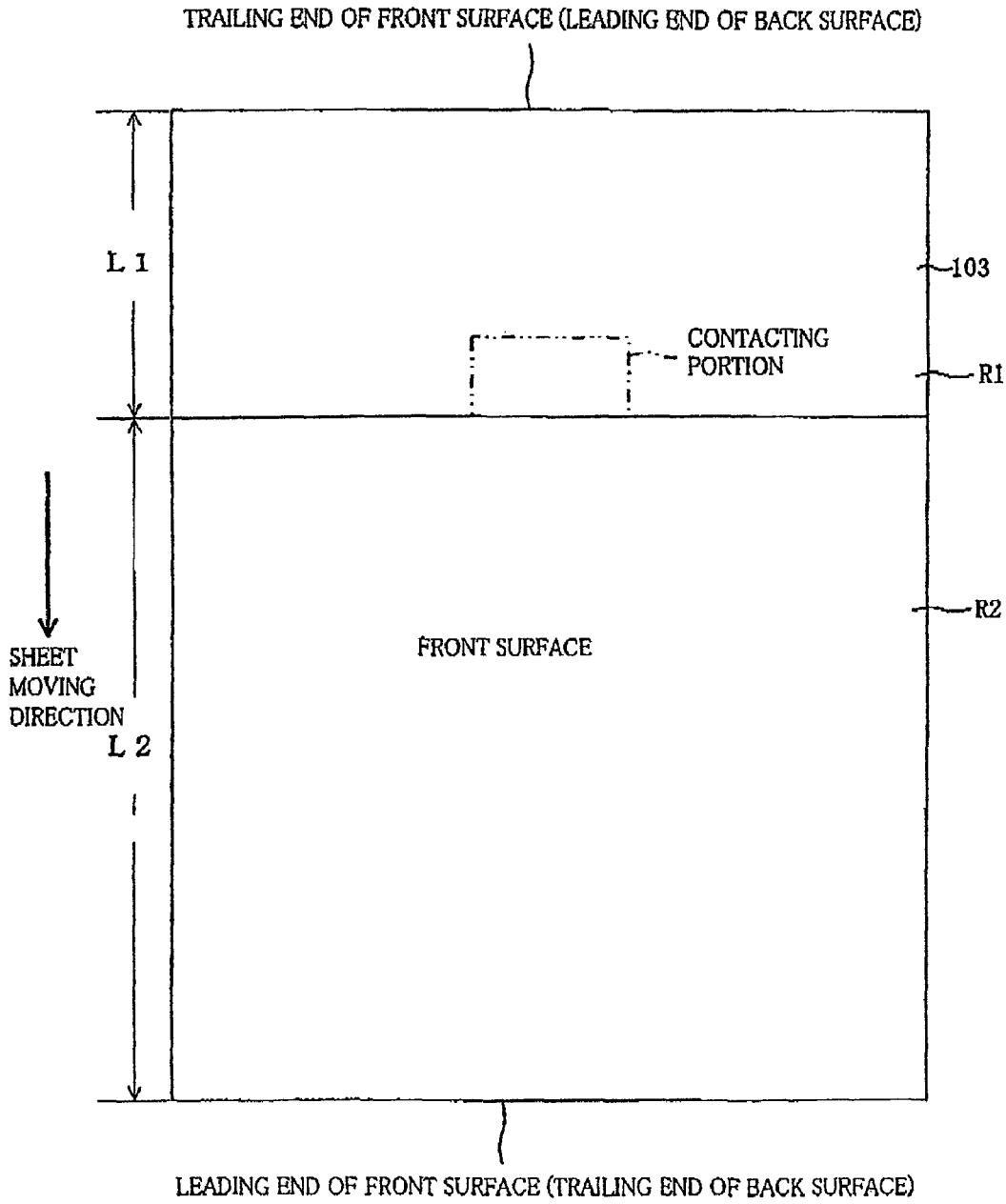
FIG. 11 is a plan view of a front surface of a recording sheet.

Here, there will be explained the detection of the ejected ink amount for the front surface of the recording sheet 103 with reference to FIG. 11. It is noted that, in FIG. 11, a direction in which the recording sheet 103 is transferred between the recording head 39 and the platen 42 is defined as a sheet moving direction which is reversed with respect to the recording sheet 103 when a direction in which the recording sheet 103 is transferred is changed. Further, an end portion of the recording sheet 103 which is located near a bottom of a sheet of FIG. 11 is shown as a leading end of the front surface when the image is recorded on the front surface (i.e., a trailing end of the back surface when the image is recorded on the back surface), while an end portion of the recording sheet 103 which is located near a top of the sheet of FIG. 11 is shown as a trailing end of the front surface when the image is recorded on the front surface (i.e., a leading end of the back surface when the image is recorded on the back surface). Furthermore, an area of the recording sheet 103 which expands from the trailing end of the front surface (i.e., the leading end of the back surface) to a distance L1 is shown as a first area R1, while a rest of the area of the recording sheet 103 is shown as a second area R2. That is, the second area R2 of the recording sheet 103 expands from the leading end of the front surface (the trailing end of the back surface) of the recording sheet 103 to a distance L2.

The distance L1 is a distance from the trailing end of the front surface (the leading end of the back surface) to a contacting portion of the recording sheet 103 at which the sheet-supply roller 25 contacts the front surface of the recording sheet 103 (referring to two-dot chain line in FIG. 11) at a second stopping position, referring to FIG. 12E, of the recording sheet 103 which will be explained below, in a state in which the recording sheet 103 is stopped in the sheet-supply path 23*a*. The distance L2 is a distance from the leading end of the front surface (the trailing end of the back surface) of the recording sheet 103 to the contacting portion.

As the ejected ink amount for the front surface, each of an amount of the ink ejected onto the first area R1 and an amount of the ink ejected onto the second area R2 is detected. It is noted that, in this MFD 10, each of the ejected ink amount for the first area R1 and the ejected ink amount for the second area R2 is detected by a number of the ejection of the ink onto a corresponding one of the areas R1, R2. However, a method of the detection of the ink ejected amount is not limited to this method, and the MFD 10 may be configured to detect the ejected ink amount by ink consumption amount or an amount of data for commanding the ejection of the ink, for example.

As shown in FIG. 10, where the image recording operation for the front surface and the detection of the ejected ink amount are started, the recording sheet 103 is intermittently transferred by the sheet-feed roller 60 and the pinch roller 31, and the image recording operation is performed on the front surface of the recording sheet 103 by the recording head 39 while sliding the carriage 38 in a state in which the recording sheet 103 is stopped.

When the recording sheet 103 reaches the sheet-discharge roller 62 and the spur rollers 63, the sheet-discharge roller 62 and the spur rollers 63 are driven, so that the recording sheet 103 is transferred further downward by the sheet-discharge roller 62 and the spur rollers 63. Then, when the recording sheet 103 reaches the first roller 45 and the second rollers 46, the first roller 45 and the second rollers 46 are driven, so that the recording sheet 103 is transferred further downward by the first roller 45 and the second rollers 46. During these transferrings, the image recording operation for the front surface of the recording sheet 103 and the detection of the ejected ink amount are finished in S2.

When the image recording operation on the front surface is finished, a first drying time T1 required for drying of the ejected ink on the first area R1 and a second drying time T2 required for drying of the ejected ink on the second area R2 are calculated in S3 in accordance with the respective ejected ink amounts for the first area R1 and the second area R2.

Figure 12A:
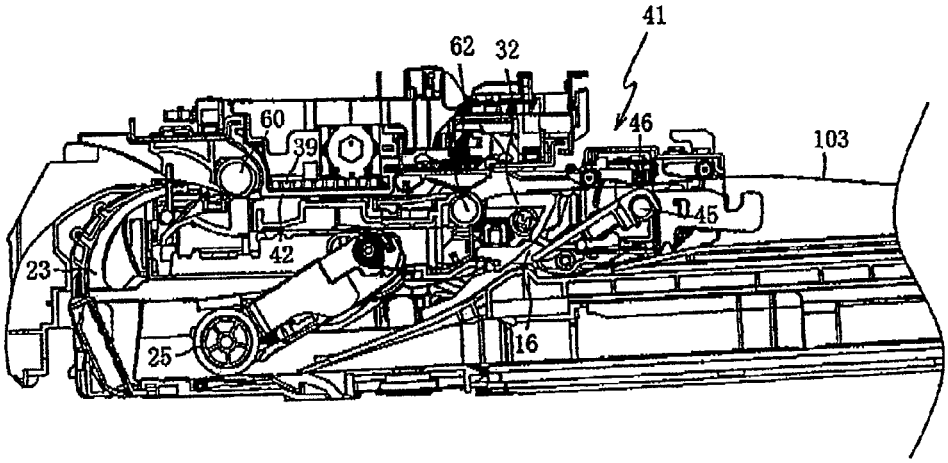
FIGS. 12A, 12B, 12C, 12D, 12E, 12F, and 12G are cross-sectional views respectively showing states of the recording sheet in a time series in a two-sided recording operation.

Then, in S4, as shown in FIG. 12A, the recording sheet 103 is transferred by the first roller 45 and the second rollers 46 to a first stopping position at which the recording sheet 103 is nipped by the first roller 45 the second rollers 46 and at which an upstream end or the trailing end of the front surface of the recording sheet 103 is supported by the first upper guide face 32*b* extending toward a downstream side of the sheet-discharge roller 62. At the first stopping position, the first roller 45 and the second rollers 46 are stopped to be driven.

Figure 12B:
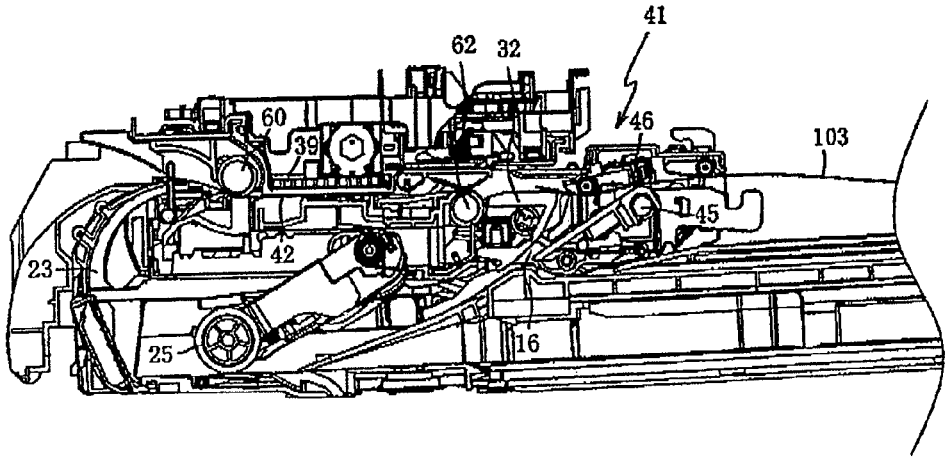

Thereafter, the path-switching portion 41 is driven, in S5, such that the path-switching member 41*a* taking the recording sheet discharged posture shown in FIG. 12A is changed to a recording sheet holding posture shown in FIG. 12B. It is noted that, in this MFD 10, the recording sheet holding posture is a posture, as shown in FIG. 12B, at which the path-switching member 41*a* is pivoted to a position intermediate between the recording sheet discharged posture shown in FIGS. 4 and 12A and the recording sheet reversed posture shown in FIGS. 5 and 12C.

When the path-switching member 41*a* is changed from the recording sheet discharged posture shown in FIG. 12A to the recording sheet holding posture shown in FIG. 12B, the path-switching member 41*a* is pivoted about the central shaft 52 of the first roller 45. That is, the second rollers 46 roll on a peripheral surface of the first roller 45 while nipping the recording sheet 103, and the auxiliary rollers 47 press the recording sheet 103 from the front surface thereof toward the sheet-return path 16.

Then, after the path-switching member 41*a* is changed to the recording sheet holding posture shown in FIG. 12B, the recording sheet 103 is stopped, in S6, for the first drying time T1 with the path-switching member 41*a* taking the recording sheet holding posture.

As a result, before the first area R1 of the recording sheet 103 is brought into contact with the sheet-supply roller 25, a drying time required for drying of the first area R1 of the recording sheet 103 can be secured. Thus, the image recorded on the first area R1 can be prevented from transferring to the sheet-supply roller 25 by the contacting of the first area R1 of the recording sheet 103 with the sheet-supply roller 25. In other words, the ink on the first area R1 can be prevented from adhering to the sheet-supply roller 25 by the contacting of the first area R1 of the recording sheet 103 with the sheet-supply roller 25.

Further, the recording sheet 103 takes, as shown in FIG. 12B, a state in which the recording sheet 103 is bent by the auxiliary rollers 47 of the path-switching member 41*a* from the front surface of the recording sheet 103 toward the sheet-return path 16 so as to have the generally V-shaped cross section. The recording sheet 103 is stopped for the first drying time T1 while taking the above-mentioned state, so that the recording sheet 103 can be curled. Thus, the recording sheet 103 is prevented from floating up from the platen 42 when the image recording operation is performed on the back surface of the recording sheet 103, so that the leading end of the back surface (the trailing end of the front surface) is more likely to be guided to the sheet-supply roller 25. This prevents jamming of the recording sheet 103 caused by an abutting contact of the leading end of the back surface of the recording sheet 103 whose front surface has been subjected to the image recording operation with the sheet-supply roller 25.

Figure 12C:
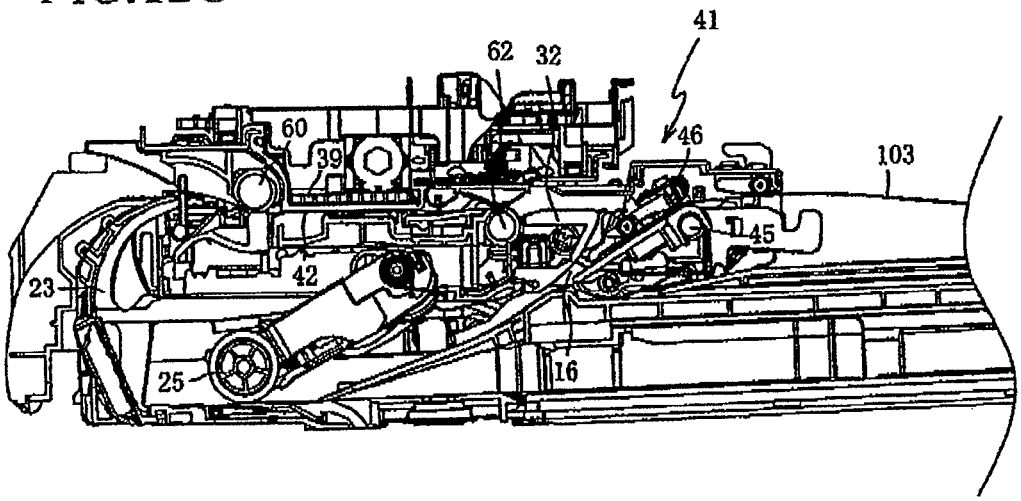

Thereafter, when the first drying time T1 has passed, the path-switching portion 41 is driven, in S7, such that the path-switching member 41*a* is changed from the recording sheet holding posture shown in FIG. 12B to the recording sheet reversed posture shown in FIG. 12C.

When the path-switching member 41*a* is changed to the recording sheet reversed posture, the path-switching portion 41 is pivoted, similarly to the above-described manner, about the central shaft 52 of the first roller 45, and further the auxiliary rollers 47 press the recording sheet 103. Thus, the recording sheet 103 is pressed by the auxiliary rollers 47 from the front surface toward the sheet-return path 16, whereby an upstream end of the recording sheet 103 (i.e., the trailing end of the front surface or the leading end of the back surface of the recording sheet 103) is introduced, as shown in FIG. 12C, into the sheet-return path 16.

Figure 12D:
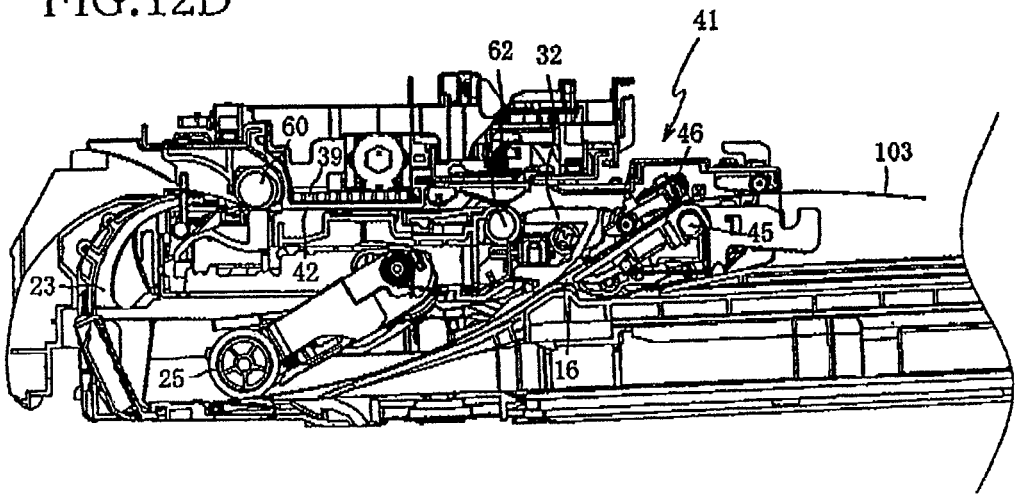

Then, in S8, the first roller 45 and the second rollers 46 are driven so as to be reversely rotated, the recording sheet 103 is transferred toward the sheet-supply roller 25 in the sheet-return path 16. Thereafter, in S9, as shown in FIG. 12D, when the leading end of the back surface of the recording sheet 103 (i.e., the trailing end of the front surface of the recording sheet 103) reaches the sheet-supply roller 25, the sheet-supply roller 25 is driven.

It is noted that the sheet-supply roller 25 is driven when a specific time has passed from a timing when the recording sheet 103 reaches the sheet-supply roller 25. During the specific time, the first roller 45 and the second rollers 46 are continued to be reversely rotated. Thus, an inclination of a longitudinal direction of the recording sheet 103 with respect to the sheet-returning direction can be corrected, thereby improving reliability of resupplying, by the sheet-supply roller 25, the recording sheet 103.

Figure 12E:
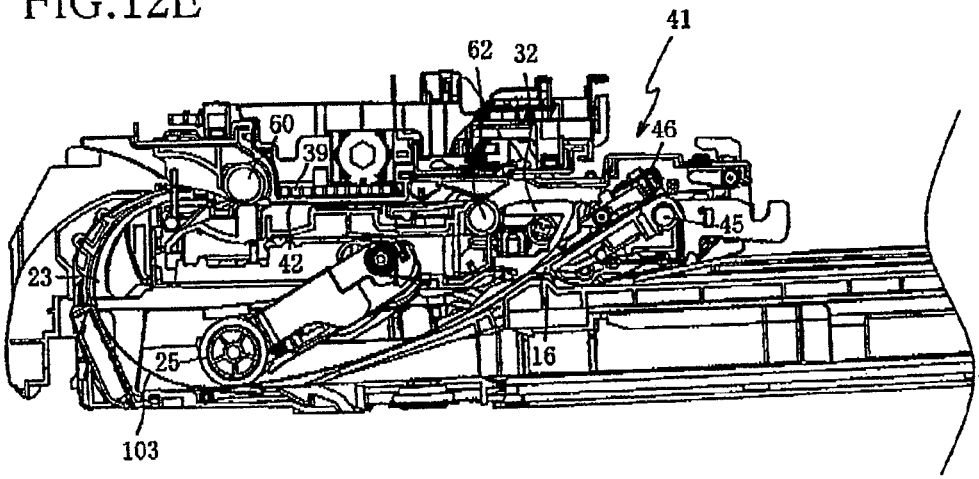

In S10, the sheet-supply roller 25 is driven such that the sheet-supply roller 25, the first roller 45, and the second rollers 46 transfer the recording sheet 103 to the second stopping position in which the recording sheet 103 is deformed in the sheet-transfer path 23 so as to have a U-shape as shown in FIG. 12E. Then, at the second stopping position, the rotations of the sheet-supply roller 25, the first roller 45, and the second rollers 46 are stopped.

In S11, it is judged whether the difference time (T2-T1) between the second drying time T2 and the first drying time T1 is equal to or shorter than a predetermined time T3 as a time for which the recording sheet 103 is to be stopped at the second stopping position. Where the difference time (T2−T1) is equal to or shorter than the predetermined time T3 (S11: Yes), the recording sheet 103 is, in S12, stopped at the second stopping position for the predetermined time T3 as a first time.

The predetermined time T3 is a time required for curling the recording sheet 103. Thus, when the recording sheet 103 is stopped for the predetermined time T3 in a state in which the recording sheet 103 is deformed in the sheet-supply path 23*a* so as to have the U-shape, the recording sheet 103 can be curled as desired.

Thus, the recording sheet 103 can be transferred into between the sheet-feed roller 60 and the pinch roller 31 without the jamming Further, the recording sheet 103 can be smoothly transferred to a space between the recording head 39 and the platen 42. Furthermore, the recording sheet 103 is curled by being stopped for the predetermined time T3 in a state in which the recording sheet 103 is deformed in the sheet-supply path 23*a* so as to have the U-shape. Thus, the recording sheet 103 can be curled with a simple structure without mounting an additional physical component on the MFD 10 and without upsizing the MFD 10 in order to curl the recording sheet 103 in shape. Further, the second area R2 of the recording sheet 103 which has not passed through the sheet-supply roller 25 can dry during the stopping of the recording sheet 103 for the predetermined time T3. Thus, the time for curling the recording sheet 103 coincides with the time for drying of the recording sheet 103, whereby the two-sided recording operation can be speedily performed.

Figure 12F:
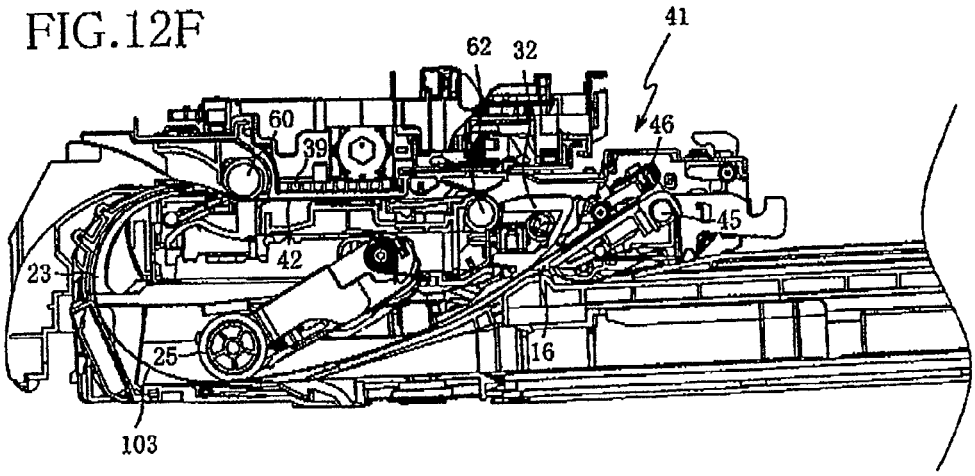

On the other hand, where it is judged in S11 that the difference time (T2−T1) is longer than the predetermined time T3 (S11; No), the recording sheet 103 is, in 513, stopped at the second stopping position for the difference time (T2−T1). Where the difference time (T2−T1) is equal to or shorter than the predetermined time T3, the second drying time T2 required for the drying of the second area R2 has already passed. Thus, there is no need to stop the recording sheet 103 for any time after the predetermined time T3 has passed. As a result, an image recorded on the second area R2 can be prevented from transferring to the sheet-supply roller 25, and images can be speedily recorded on the both sides or surfaces of the recording sheet 103.

Where the difference time (T2−T1) is longer than the predetermined time T3, the second drying time T2 required for the drying of the second area R2 has not yet passed. Thus, the image recorded on the second area R2 can be prevented from transferring to the sheet-supply roller 25 by stopping the recording sheet 103 until the difference time (T2−T1) has passed.

Where the recording sheet 103 is stopped at the second stopping position for the predetermined time T3 or the difference time (T2−T1), the recording sheet 103 is reversed as shown in FIG. 12F in the sheet-supply path 23*a* such that the back surface (a surface of the recording sheet 103 opposite to a surface thereof having contacted the sheet-supply roller 25) is to face the nozzle surface of the recording head 39 after the predetermined time T3 or the difference time (T2−T1) has passed. Then, in S14, the image recording operation is started to be performed on the back surface of the recording sheet 103 by the recording head 39.

Figure 12G:
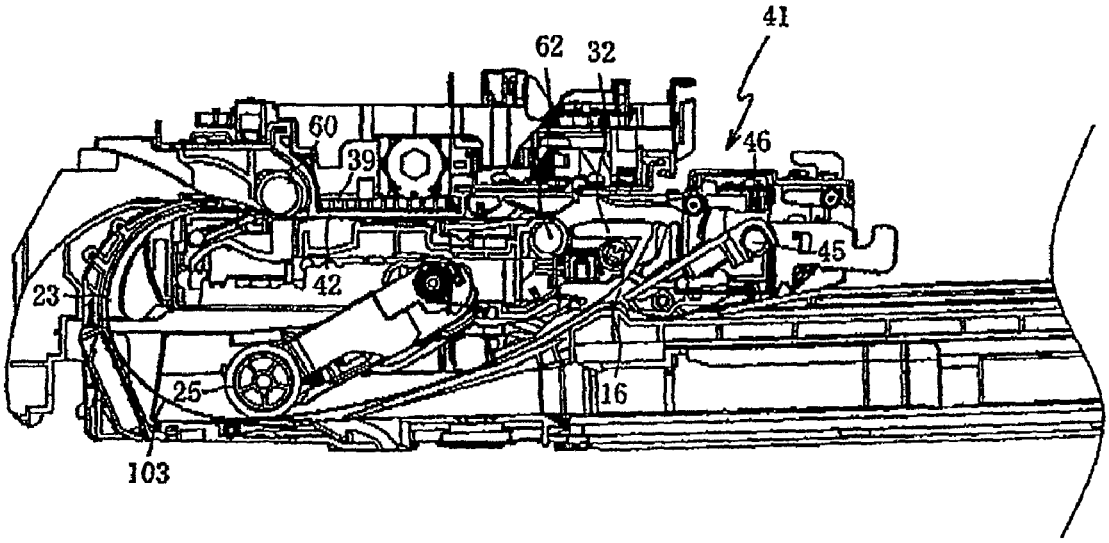

Then, as shown in FIG. 12G, before the leading end portion of the recording sheet 103 (i.e., the leading end of the back surface of the recording sheet 103) reaches the path-switching portion 41, the path-switching member 41*a* is driven, in S15, so as to be changed from the recording sheet reversed posture to the recording sheet discharged posture again. Thereafter, the image recording operation has been performed on the back surface of the recording sheet 103 in S16, and the recording sheet 103 which has been subjected to the two-sided recording operation is transferred downstream in the sheet transferring direction by the first roller 45 and the second rollers 46. During this transferring of the recording sheet 103, the first roller 45 and the second rollers 46 are forwardly rotated, whereby the recording sheet 103 is discharged, in S17, onto the sheet-discharge tray 21.

In view of the above, the controller 84 can be considered to include a detecting section configured to detect, in S1 and S2, the amount of the ink ejected onto the first area R1 and the amount of the ink ejected onto the second area R2.

In view of the above, the controller 84 can be considered to further include a calculating section configured to calculate, in S3, the first drying time T1 required for the drying of the first area R1, on the basis of the detected amount of the ink ejected onto the first area R1, and configured to calculate the second drying time T2 required for the drying of the second area R2, on the basis of the detected amount of the ink ejected onto the second area R2.

In view of the above, the controller 84 can be considered to further include a sheet-stopping control section configured to control, in S6, the first and second rollers 45, 46 and the path-switching member 41*a* such that the recording sheet 103 whose front surface has been subjected to the image recording operation is stopped for the first drying time T1 as a second time, before the recording sheet 103 to be transferred through the sheet-return path 16 by the first and second rollers 45, 46 reaches the sheet-supply roller 25. The recording sheet 103 is stopped in a state in which the recording sheet 103 is nipped by the first and second rollers 45, 46 while the trailing end of the front surface of the recording sheet 103 is supported by the first upper guide face 32*b*, and in which the recording sheet 103 is pressed from the front surface thereof toward the sheet-return path 16 by the path-switching member 41*a*, at a portion of the front surface thereof located between the first upper guide face 32*b* and the first and second rollers 45, 46, such that the recording sheet 103 is bent with a generally V-shape in cross section.

In view of the above, the controller 84 can be considered to further include a judging section configured to judge, in S11, whether the difference time (T2−T1) is equal to or shorter than the predetermined time T3 on the condition that the second drying time T2 is longer than the first drying time T1.

In view of the above, the sheet-stopping control section is further configured to control, in S12, the sheet-supply roller 25 such that the recording sheet 103 transferred by the sheet-supply roller 25 is stopped in the sheet-supply path 23*a* for the predetermined time T3 as the first time at a timing when the first area R1 of the front surface of the recording sheet 103 has just passed through the sheet-supply roller 25, where the judging section has judged that the difference time (T2−T1) is equal to or shorter than the predetermined time T3. The sheet-stopping control section is further configured to control, in S13, the sheet-supply roller 25 such that the recording sheet

103 transferred by the sheet-supply roller 25 is stopped in the sheet-supply path 23*a* for the difference time (T2–T1) as the first time where the judging section has judged that the difference time (T2-T1) is longer than the predetermined time T3.

It is to be understood that the invention is not limited to the details of the illustrated embodiment, but may be embodied with various changes and modifications, which may occur to those skilled in the art, without departing from the spirit and scope of the present invention.

In the illustrated embodiment, there is explained a case in which each of the first area R1 and the second area R2 includes an area which does not contact the sheet-supply roller 25. However, the MFD 10 may be configured such that each of the first area R1 and the second area R2 is limited to an area which contacts the sheet-supply roller 25. Where the MFD 10 is configured as such, an area in which the ejected ink amount is to be detected is enough to be a small area, thereby reducing a load required for the detection of the ejected ink amount and thereby recognizing, more accurately, a drying time required for preventing the image recorded on the front surface of the recording sheet 103 from being transferred to the sheet-supply roller 25, that is, for preventing the ink on the front surface of the recording sheet 103 from adhering to the sheet-supply roller 25

Further, the MFD 10 may be configured such that the respective lengths of the times for which the recording sheet 103 is stopped at the first stopping position and the second stopping position are changed on the basis of a sheet-type of the recording sheet 103 and ambient conditions such as a temperature and a humidity. For example, where the recording sheet 103 is a paper, such as a postcard, having a higher stiffness than a plain paper, it requires a shorter time to curl the recording sheet 103 than where the recording sheet 103 is the plain paper. Thus, the MFD 10 may be configured such that the respective lengths of the times for which the recording sheet 103 is stopped at the first stopping position and the second stopping position are changed to be shorter than where the recording sheet 103 is the plain paper. In contrast, where the recording sheet 103 is a sheet, such as a thin paper, having a lower stiffness than the plain paper, it requires a longer time to curl the recording sheet 103 than where the recording sheet 103 is the plain, paper. Thus, the MFD 10 may be configured such that the respective lengths of the times for which the recording sheet 103 is stopped at the first stopping position and the second stopping position are changed to be longer than where the recording sheet 103 is the plain paper. Further, the higher the humidity is, the less ink dries. Thus, the MFD 10 may be configured such that the respective lengths of the times for which the recording sheet 103 is stopped at the first stopping position and the second stopping position are changed to be relatively long where the humidity is relatively high. In contrast, the lower the humidity is, the more ink dries. Thus, the MFD 10 may be configured such that the respective lengths of the times for which the recording sheet 103 is stopped at the first stopping position and the second stopping position are changed to be relatively short where the humidity is relatively low. Where the MFD 10 is thus configured, the recording sheet can be curled more reliably, and the transferring of the image recorded on the front surface of the recording sheet 103 to the sheet-supply roller 25 can be prevented more reliably.

What is claimed is:

1. An image recording apparatus configured to record images on a front surface and a back surface of a recording sheet, the image recording apparatus comprising:

a recording head which ejects ink onto the recording sheet for recording;

a sheet-supply roller which contacts the recording sheet and transfers the recording sheet for supplying the recording sheet to the recording head;

a U-shaped sheet-supply path which is provided between the sheet supply roller and the recording head, which has a U-shape along a sheet transferring direction, and through which the recording sheet is transferred such that one of surfaces thereof opposite to the other of the surfaces contacted by the sheet-supply roller faces the recording head;

a re-feed mechanism configured to feed the recording sheet on which the ink has been ejected to record an image on the front surface thereof, to the U-shaped sheet-supply path such that the sheet is turned upside down; and a controller configured to execute controls for operations of the image recording apparatus, wherein the controller includes a sheet-stopping control section configured to control the re-feed mechanism such that the recording sheet transferred by the re-feed mechanism is stopped for a particular length of time in the U-shaped sheet-supply path, after the recording sheet on which the ink had been ejected to record an image on the front surface thereof has been reversed to the U-shaped sheet-supply path and before an image is recorded on the back surface of the recording sheet, and wherein the sheet-stopping control section is configured to control the re-feed mechanism such that the recording sheet is stopped for the particular length of time in accordance with an amount of the ink ejected on the recording sheet by the recording head.

2. The image recording apparatus according to claim 1, wherein the re-feed mechanism includes the sheet-supply roller, and wherein the sheet-supply roller is rotatable to feed, to the U-shaped sheet-supply path, the recording sheet on which the ink has been ejected to record an image on the front surface thereof.

3. An image recording apparatus configured to record images on a front surface and a back surface of a recording sheet, the image recording apparatus comprising:

a recording head which ejects ink onto the recording sheet for recording;

a sheet-supply roller which contacts the recording sheet and transfers the recording sheet for supplying the recording sheet to the recording head;

a U-shaped sheet-supply path which is provided for supplying the recording sheet, which has a U-shape along a sheet transferring direction, and through which the recording sheet is transferred;

a re-feed mechanism configured to feed the recording sheet on which the ink has been ejected to record an image on the front surface thereof, to the U-shaped sheet-supply path such that the sheet is turned upside down; and a controller configured to execute controls for operations of the image recording apparatus, wherein the controller includes a sheet-stopping control section configured to stop the recording sheet transferred by the re-feed mechanism, for a particular length of time in the U-shaped sheet-supply path after the recording sheet on which the ink had been ejected to record an image on the front surface thereof has been reversed to the U-shaped sheet-supply path and before an image is recorded on the back surface of the recording sheet, and wherein the sheet-stopping control section is configured to control the re-feed mechanism, such that the recording sheet is stopped for the particular length of time based on an ejection parameter used by the recording head for recording an image on the front surface of the recording sheet.

4. The image recording apparatus according to claim 3, wherein the re-feed mechanism includes the sheet-supply roller, and wherein the sheet-supply roller is rotatable to feed, to the U-shaped sheet-supply path, the recording sheet on which the ink has been ejected to record an image on the front surface thereof.

5. The image recording apparatus according to claim 3, wherein the U-shaped sheet-supply path is provided between the sheet-supply roller and the recording head, the recording sheet being transferred through the U-shaped sheet-supply path such that one of surfaces thereof opposite to the other of the surfaces contacted by the sheet-supply roller faces the recording head.

6. The image recording apparatus according to claim 3, wherein the controller includes a determining section configured to determine the amount of the ink ejected on the recording sheet on the basis of recording data based on which the recording is performed on the front surface of the recording sheet.

7. The image recording apparatus according to claim 3, wherein the ejection parameter is at least one ejecting position at which the ink is ejected on the front surface of the recording sheet in the sheet transferring direction.

8. The image recording apparatus according to claim 3, wherein the ejection parameter is an amount of ink ejected on a downstream portion of the front surface of the recording sheet in the sheet transferring direction.

9. The image recording apparatus according to claim 3, wherein the ejection parameter is an amount of ink ejected on the downstream portion of the front surface in the sheet transferring direction and an amount of the ink ejected on an upstream portion of the front surface of the recording sheet in the sheet transferring direction.

10. An image recording apparatus configured to record images on a front surface and a back surface of a recording sheet, the image recording apparatus comprising:

a recording head which ejects ink onto the recording sheet for recording;

a sheet-supply roller which contacts the recording sheet and transfers the recording sheet for supplying the recording sheet to the recording head;

a U-shaped sheet-supply path which is provided for supplying the recording sheet, which has a U-shape along a sheet transferring direction, and through which the recording sheet is transferred;

a re-feed mechanism configured to feed the recording sheet on which the ink has been ejected to record an image on the front surface thereof, to the U-shaped sheet-supply path such that the sheet is turned upside down; and a controller configured to execute controls for operations of the image recording apparatus, wherein the controller includes a sheet-stopping control section configured to stop the recording sheet transferred by the re-feed mechanism, for a particular length of time in the U-shaped sheet-supply path after the recording sheet on which the ink had been ejected to record an image on the front surface thereof has been reversed to the U-shaped sheet-supply path and before an image is recorded on the back surface of the recording sheet, wherein the re-feed mechanism includes the sheet-supply roller, wherein the sheet-supply roller is rotatable to feed, to the U-shaped sheet-supply path, the recording sheet on which the ink has been ejected to record an image on the front surface thereof, wherein the sheet-stopping control section is configured to control the re-feed mechanism such that the recording sheet transferred by the re-feed mechanism is stopped for the particular length of time in the U-shaped sheet-supply path after the recording sheet on which the ink had been ejected to record the image on the front surface thereof has been reversed to the U-shaped sheet-supply path and before an image is recorded on the back surface of the recording sheet, and wherein the particular length of time is determined according to the amount of the ink ejected on the recording sheet by the recording head.

11. An image recording apparatus configured to record images on a front surface and a back surface of a recording sheet, the image recording apparatus comprising:

a recording head which ejects ink onto the recording sheet for recording;

a sheet-supply roller which contacts the recording sheet and transfers the recording sheet for supplying the recording sheet to the recording head;

a U-shaped sheet-supply path which is provided for supplying the recording sheet, which has a U-shape along a sheet transferring direction, and through which the recording sheet is transferred;

a re-feed mechanism configured to feed the recording sheet on which the ink has been ejected to record an image on the front surface thereof, to the U-shaped sheet-supply path such that the sheet is turned upside down; and a controller configured to execute controls for operations of the image recording apparatus, wherein the controller includes a sheet-stopping control section configured to stop the recording sheet transferred by the re-feed mechanism, for a particular length of time in the U-shaped sheet-supply path after the recording sheet on which the ink had been ejected to record an image on the front surface thereof has been reversed to the U-shaped sheet-supply path and before an image is recorded on the back surface of the recording sheet, wherein the controller includes a determining section configured to determine the amount of the ink ejected on the recording sheet on the basis of recording data based on which the recording is performed on the front surface of the recording sheet, and wherein the sheet-stopping control section is configured to stop the recording sheet for the particular length of time in accordance with an amount of the ink ejected on the front surface of the recording sheet by the recording head.

12. The image recording apparatus according to claim 11, wherein the determining section configured to determine an amount of the ink on an upstream portion of the front surface of the recording sheet in the sheet transferring direction and configured to determine an amount of the ink on a downstream portion of the front surface of the recording sheet in sheet transferring direction, wherein the controller includes a calculating section configured to calculate a first drying time required for drying of the upstream portion, on the basis of the determined amount of the ink ejected onto the upstream portion and configured to calculate a second drying time required for drying of the downstream portion, on the basis of the determined amount of the ink ejected onto the downstream portion, and wherein the sheet-stopping control section is configured to control the re-feed mechanism such that the recording sheet is stopped for the particular length of time in accordance with the calculated first and second drying times.

13. An image recording apparatus configured to record images on a front surface and a back surface of a recording sheet, the image recording apparatus comprising:

a recording head which ejects ink onto the recording sheet for recording;

a sheet-supply roller which contacts the recording sheet and transfers the recording sheet for supplying the recording sheet to the recording head;

a U-shaped sheet-supply path which is provided between the sheet-supply roller and the recording head, which has a U-shape along a sheet transferring direction, and through which the recording sheet is transferred such that one of surfaces thereof opposite to the other of the surfaces contacted by the sheet-supply roller faces the recording head;

a re-feed mechanism configured to feed the recording sheet on which the ink has been ejected to record an image on the front surface thereof, to the U-shaped sheet-supply path such that the sheet is turned upside down; and a controller configured to execute controls for operations of the image recording apparatus, wherein the controller includes a sheet-stopping control section configured to control the re-feed mechanism such that the recording sheet transferred by the re-feed mechanism is stopped for a particular length of time in the U-shaped sheet-supply path, after the recording sheet on which the ink had been ejected to record an image on the front surface thereof has been reversed to the U-shaped sheet-supply path and before an image is recorded on the back surface of the recording sheet, and wherein the sheet-stopping control section is configured to control the re-feed mechanism such that the recording sheet is stopped for the particular length of time in accordance with recording data based on which the recording is performed on the front surface of the recording sheet.

14. The image recording apparatus according to claim 13, wherein the re-feed mechanism includes the sheet-supply roller, and wherein the sheet-supply roller is rotatable to feed, to the U-shaped sheet-supply path, the recording sheet on which the ink has been ejected to record an image on the front surface thereof.

15. The image recording apparatus according to claim 13, wherein the recording data includes image data, and wherein the sheet-stopping control section is configured to control the re-feed mechanism such that the recording sheet is stopped for the particular length of time in accordance with an amount of the recording data.

* * * * *